US011511892B2

(12) United States Patent
Luo et al.

(10) Patent No.: US 11,511,892 B2
(45) Date of Patent: Nov. 29, 2022

(54) WINDING MACHINE

(71) Applicant: HANGZHOU YOUNGSUN INTELLIGENT EQUIPMENT CO., LTD., Zhejiang (CN)

(72) Inventors: Bangyi Luo, Zhejiang (CN); Jianmin Lin, Zhejiang (CN); Caiqin Zhang, Zhejiang (CN)

(73) Assignee: Hangzhou Youngsun Intelligent Equipment Co., Ltd., Hangzhou (CN)

( * ) Notice: Subject to any disclaimer, the term of this patent is extended or adjusted under 35 U.S.C. 154(b) by 0 days.

(21) Appl. No.: 17/280,601

(22) PCT Filed: Aug. 29, 2019

(86) PCT No.: PCT/CN2019/103269
§ 371 (c)(1),
(2) Date: Mar. 26, 2021

(87) PCT Pub. No.: WO2020/063245
PCT Pub. Date: Apr. 2, 2020

(65) Prior Publication Data

US 2022/0033118 A1 Feb. 3, 2022

(30) Foreign Application Priority Data

Sep. 28, 2018 (CN) ..... 201821595567.8
Jun. 14, 2019 (CN) ..... 201920900991.7
(Continued)

(51) Int. Cl.
*B65B 59/04* (2006.01)
*B65B 11/04* (2006.01)

(52) U.S. Cl.
CPC ..... *B65B 11/045* (2013.01); *B65B 59/04* (2013.01)

(58) Field of Classification Search
USPC ..... 53/211
See application file for complete search history.

(56) References Cited

U.S. PATENT DOCUMENTS

2007/0143772 A1* 6/2007 Liu ..... G11B 17/0282 720/695
2014/0353896 A1* 12/2014 Casadei ..... B65B 65/02 269/61

FOREIGN PATENT DOCUMENTS

CN 200960983 Y 10/2007
CN 201761648 U 3/2011
(Continued)

*Primary Examiner* — Chinyere J Rushing-Tucker
(74) *Attorney, Agent, or Firm* — Muncy, Geissler, Olds & Lowe, P.C.

(57) ABSTRACT

The present invention provides a central shaft mechanism, which is arranged on the base of a winding machine, including a central shaft component, a central shaft is arranged in the central part of the central shaft component, the central shaft component is also provided with a bearing support structure and a plurality of first limiting structures, and the central shaft component is fixed and limited in the base of the winding machine through the first limiting structures. The central shaft mechanism of the present invention has stable position, stable and reliable operation, and can reduce the working noise and noise during operation. In addition, it can be packed separately from the base during transportation, and can be quickly installed on site, which can not only provide more stable support, but also reduce the height of the turntable of the height winding machine.

10 Claims, 20 Drawing Sheets

(30) Foreign Application Priority Data

| | | |
|---|---|---|
| Jun. 14, 2019 | (CN) | 201920903836.0 |
| Jun. 14, 2019 | (CN) | 201920903946.7 |
| Jun. 21, 2019 | (CN) | 201910540491.1 |
| Jun. 21, 2019 | (CN) | 201920946829.9 |
| Jun. 21, 2019 | (CN) | 201920949305.5 |
| Aug. 20, 2019 | (CN) | 201921350590.5 |

(56) References Cited

FOREIGN PATENT DOCUMENTS

| | | | | | |
|---|---|---|---|---|---|
| CN | 104973281 | A | | 10/2015 | |
| CN | 204916266 | U | | 12/2015 | |
| CN | 207015625 | U | | 2/2018 | |
| CN | 207089724 | U | | 3/2018 | |
| CN | 207773550 | U | | 8/2018 | |
| GB | 505780 | A | * | 5/1939 | D07B 7/14 |
| JP | H11314617 | A | | 11/1999 | |
| JP | 2002166906 | A | | 6/2002 | |

* cited by examiner

WINDING MACHINE

TECHNICAL FIELD

The present invention relates to a winding machine and a central shaft mechanism in a turntable device of the winding machine.

BACKGROUND

Winding machine is a kind of mechanical equipment in the field of packaging machinery, which is used for winding packaging film on the surface of goods. The present invention comprises a turntable on which the articles are placed and rotated with the turntable so as to wind the packaging film on the surface of the articles. The turntable is rotatably installed on the base of the winding machine, and a central shaft mechanism is arranged on the base to connect the rotating mechanism. The turntable and its corresponding base are flat structures with large horizontal dimension and small height dimension, and the noise of the central axis often occurs. In addition, after the winding machine is transported to the destination, it is necessary to re-install the relevant parts on site. It is always hoped that these central shaft mechanisms can be installed and transported easily.

SUMMARY

The first technical problem to be solved by the present invention is to provide a winding machine whose central shaft mechanism of the turntable can reduce the working noise and noise. Therefore, the present invention adopts the following technical scheme:

A winding machine comprising a central shaft mechanism, which is arranged on the base of the winding machine, wherein it comprises a central shaft component with a central shaft arranged in the central part of the central shaft component, and the central shaft component is also provided with a bearing support structure and a plurality of first limiting structures, which the central shaft component is fixed and limited in the base of the winding machine through the first limiting structures.

On the basis of adopting the above technical scheme, the present invention can also adopt the following further technical schemes or use these further technical schemes in combination:

According to the rotating direction of the turntable of the winding machine when winding the film on the article as the forward direction, the first limiting structure is limited by the limiting structure in front of it.

A plurality of first limiting structures are provided on the periphery of the central shaft component; the mounting hole of the central shaft mechanism is arranged on the base of the winding machine, and a connecting groove is arranged along the circumference of the mounting hole of the central shaft mechanism to form a limiting structure with the mounting hole of the central shaft mechanism; the notch of the connecting groove faces the mounting hole of the central shaft mechanism, and the connecting groove has an open part for the first limiting structure to be placed; the mounting hole of the central shaft mechanism and the open part form a central shaft component placing hole; by rotating the central shaft component, the first limiting structure can be clamped between the upper groove wall and the lower groove wall of the connecting groove, and the first limiting structure is connected with the upper groove wall and the lower groove wall of the connecting groove as a whole by bolts.

Further, the connecting groove is provided with a second limiting structure as a limiting structure in front of the first limiting structure.

Further, when the first limiting structure is blocked by the second limiting structure, the first limiting structure is clamped between the upper groove wall and the lower groove wall of the connecting groove, and the bolt holes arranged on the first limiting structure are aligned with the bolt holes on the upper groove wall and the lower groove wall.

Further, the first limiting structure is a key made of steel plate protruding radially from the central shaft component, and the groove bottom of the connecting groove and the outer side of the key form a central positioning fit for the central shaft component.

Further, the central shaft mechanism is provided with an upper limiting structure, which is a ring-shaped structure, and a plurality of keys protruding to the inner side are arranged on the inner side of the upper limiting structure; the keys form an upper groove wall limiting the first limiting structure, the interval between the keys forms the open part, and the central hole of the ring-shaped structure forms the central insertion hole.

Further, the upper limiting structure is made of metal plate.

Further, the central shaft mechanism is provided with a middle limit structure, which is a ring-shaped structure that forms the groove bottom of the connecting groove; the inner side has a plurality of keys protruding inward, and the keys serve as the limiting structure in front of the first limiting structure.

Further, the connecting groove is a three-layer structure; the central shaft mechanism is provided with an upper limiting structure as an upper structure; the upper limiting structure is a ring structure, and a plurality of keys protruding to the inner side are formed on the inner side, the keys form an upper groove wall limiting the first limiting structure, the interval between the keys forms the open part, the center hole of the ring structure forms the central insertion hole, and the upper limiting structure is made of metal plate; the central shaft mechanism is provided with a middle limiting structure as a middle structure; the middle limiting structure is a ring structure to form the groove bottom of the connecting groove; the inner side of the middle limit structure is provided with a plurality of keys protruding to the inner side, and the keys are used as a limiting structure in front of the first limiting structure; the middle limit structure is made of metal plate; and the lower groove wall acts as a lower structure.

The central shaft mechanism of the present invention has a stable position, operates stably and reliably, and can reduce the working noise and noise during operation; in addition, it can be packed separately from the base during transportation, and can be quickly installed on site, which can not only provide more stable support, but also reduce the height of the turntable of the height winding machine.

The present invention can also facilitate the realization of a thin winding device, and its technical scheme is:

A thin winding device comprising a turntable, a base and a chain transmission mechanism, which the turntable can be rotatably mounted on the base, wherein the winding device is provided with a central bearing device on the base, and the central bearing device is provided with two bearings, namely a first bearing connected with the central shaft and a plane bearing placed on the periphery of the first bearing; the thickness between the top surface of the turntable and the bottom surface of the base is greater than or equal to 24 mm and less than 36 mm; compared with the turntable device of the traditional chain driven winding device, the present invention greatly reduces the height of the turntable, improves the operability of the winding work, ensures the rationality of the structure, guarantees the reliability of the chain mechanism and the turntable support structure, and improves the service life of the winding device.

Further, the central bearing device comprises a central shaft component with a central shaft arranged in the central part of it, a bearing support structure and a plurality of first limiting structures, and the central shaft part is fixed and limited in the base of the winding device through the first limiting structure.

Further, according to the rotating direction of the turntable of the winding device when winding the film on the article as the forward direction, the first limiting structure is limited by the limiting structure in front of it.

Further, a plurality of first limiting structures are arranged on the periphery of the central shaft component; a central bearing device mounting hole is arranged on the base of the winding device, and a connecting groove is arranged on the periphery of the central bearing device mounting hole along the circumference to form a limiting structure with a central bearing device mounting hole; the notch of the connecting groove faces the mounting hole of the central shaft mechanism, and the connecting groove has an open part for the first limiting structure to be placed; the mounting hole of the central shaft mechanism and the open part form a central shaft component placing hole; by rotating the central shaft component, the first limiting structure can be clamped between the upper groove wall and the lower groove wall of the connecting groove, and the first limiting structure is connected with the upper groove wall and the lower groove wall of the connecting groove as a whole by bolts.

Further, the connecting groove is provided with a second limiting structure as a limiting structure in front of the first limiting structure.

Further, when the first limiting structure is blocked by the second limiting structure, the first limiting structure is clamped between the upper groove wall and the lower groove wall of the connecting groove, and the bolt holes arranged on the first limiting structure are aligned with the bolt holes on the upper groove wall and the lower groove wall.

Further, the first limiting structures are keys made of steel plate protruding radially from the central shaft component, and the groove bottom of the connecting groove and the outer side of the keys form a central positioning fit for the central shaft component.

Further, the center bearing device is provided with an upper limiting structure having a ring-shaped structure; the inner side of which is provided with a plurality of keys protruding to the inner side; the keys form an upper groove wall limiting the first limit structure, the interval between the keys forms the open part, and the central hole of the ring-shaped structure forms the insertion hole.

Further, the upper limit structure is made of metal plate.

Further, the central bearing device is provided with a middle limiting structure, which is a ring-shaped structure and forms the groove bottom of the connecting groove, the inner side of which is provided with a plurality of keys protruding to the inner side, and the keys are used as the limiting structure in front of the first limiting structure.

Another technical problem to be solved by the present invention is to provide a turntable slope mechanism in the winding machine, which can reduce the operation difficulty of large articles moving to the turntable and save the transportation volume of the winding machine. Therefore, the present invention adopts the following technical scheme:

A turntable slope mechanism which is a part of winding machine, comprising a base that includes a first end portion connected to a column at one end, a second end portion supporting the turntable at the other end, and a connecting portion between the first end portion and the second end portion, wherein a slope is arranged around the turntable, and the slope is detachably connected with the base; the present invention can move the articles on the turntable in all directions which are not blocked by the connecting portion, and no need to specially aim at the slope; at the same time, the width and angle ratio of the slope are appropriate, and the articles can be placed on the turntable relatively smoothly.

Further, the slope is composed of several sections along the circumference of the second end portion.

Further, the outer shape of the slope is basically a partial polygonal shape.

Further, the slope is composed of three sections of partitioned slopes, each section of the partitioned slopes has a main slope side corresponding to one side of the turntable, the ends of the main slope side are provided with splicing slope sides at a certain angle with the main slope side, and the slope side are composed of the adjacent partitioned slopes by the splicing slope sides on this side.

Further, some or all of the partitioned slopes are divided into several blocks.

Further, the sizes of the three partitioned slopes are basically the same.

Further, both ends of the main slope side of the three partitioned slopes are provided with the splicing slope sides at a certain angle to the main slope sides.

Further, the height T from the bottom of the winding machine to the upper surface of the turntable is greater than or equal to 24 mm and less than 36 mm.

Another technical problem to be solved by the present invention is to provide a roller mechanism in the winding machine, which can provide reliable support and facilitate the reduction of the height of the winding machine turntable. To this end, the present invention adopts the following technical scheme:

A roller mechanism, wherein the roller mechanism comprises a roller carrier, integral rollers with shafts on both sides, and bearings which are located on the shafts on both sides of the roller and in the bearing holes of the roller carrier; the roller mechanism of the present invention has reasonable structure and can reduce the overall height; when applied to the winding machine, it can not only provide more stable support, but also reduce the height of the turntable of the winding machine.

Further, the roller carrier is formed by connecting two left and right separated components, and the lower part of the roller carrier is provided with a structure for positioning and matching with the mounting hole.

Further, both sides of the left and right separated components are respectively provided with connecting arms, the ends of the connecting arms of the left and right separated components are provided with steps, and the connecting arms of the left and right separated components are coupled and fixed together through the steps at the ends.

Further, the roller mechanism is mounted on the base, the base is provided with an installation hole corresponding to the roller, and the roller is located above the hole of the installation hole.

Further, the roller mechanism is installed on the base, the mounting hole is set at the position of the roller corresponding to the base, and the height of the roller from the support plane of the base is greater than 0.7 cm and less than or equal to 2.5 cm.

Further, the lower part of the roller carrier is provided with an insertion structure matched with the mounting hole.

Further, the roller mechanism is provided with a plurality of mutually parallel integral rollers with shafts on both sides.

In the winding machine, there are a lot of rollers, which are vulnerable parts. Another technical problem to be solved by the present invention is to provide a roller mechanism in the winding machine, which can improve the service life of the rollers of the winding machine. Therefore, the present invention adopts the following technical scheme:

A roller mechanism, which is a part of a winding machine that is provided with a turntable and a base, the turntable can be rotatably installed on the base, and a roller set is arranged between the base and the turntable; wherein a number of roller are arranged at the center of the rotation center of the turntable, the plurality of rollers are arranged in groups, and their axes are arranged radially relative to the rotation center; The axle center lines of the multiple rollers of a single roller set of the roller mechanism of the present invention point directly to the center of the circle; when the turntable rotates, the assistance of the roller set fits perfectly with the rotation of the turntable without deflection wear, which is more reasonable and smooth, and can improve the service life of the rollers, provide more stable support, help to reduce the overall height of the turntable, and facilitate the replacement of parts.

Further, the plurality of rollers are arranged in circles with the center of rotation as the center according to different radii of the positions, and a plurality of roller sets are arranged in each circle.

Further, the plurality of rollers are arranged in multiple groups by taking several of the rollers as a group.

Further, the axes of the rollers of the same group are all arranged radially relative to the rotation center.

Further, the number of rollers in a group is 2-5.

Further, the roller is an integral roller with shafts on both sides, and the roller set includes a roller frame, integral rollers, and bearings, and the bearings are located on the shafts on both sides of the roller and in the bearing holes of the roller frame.

Further, the roller frame is formed by connecting two left and right separated components, and the lower part of the roller frame is provided with a structure for positioning and matching with the mounting hole.

Further, there are connecting arms on both sides of the left and right separated components respectively, the ends of the connecting arms of the left and right separated components have steps, and the connecting arms of the left and right split components are coupled and fixed together through the steps at the ends.

Further, the base is provided with a mounting hole corresponding to the position of the roller, and the lower part of the roller frame has an insertion structure that matches with the mounting hole.

The vertical column of the winding machine is installed on the base, and the vertical column is provided with a lifting film frame and its lifting mechanism and electric control component. The column is generally assembled by direct splicing and assembly of multiple shell parts. In order to facilitate transportation and save installation steps, currently the column is hinged and installed on the base, and the column is placed during transportation. At the use site, there is no need to carry out the assembly steps of shell parts. Because bumps are unavoidable during transportation, with this structure, the shell parts are easily bumped and deformed during transportation, which affects the appearance, and the arrangement makes the entire column unable to be assembled and can only be replaced. Another technical problem to be solved by the present invention is to provide a column mechanism for the winding machine, which takes into account the risk of transportation damage and the on-site installation workload of the column. To this end, the present invention adopts the following technical scheme:

A column mechanism, which is a part of a winding machine and comprises a column, a base, and a turntable, wherein the column includes a column frame which is connected to the base, a plurality of column panels which at least a part of the column panel is detachably connected to the column frame, or detachably connected to the adjacent column panels; the column structure of the present invention has simple installation and convenient processing, which is convenient for processing and transportation, meets the requirements of column strength and installation convenience, and can avoid the problem of column replacement.

Further, the column panel detachably connected to the column frame comprises an electric control door.

Further, the column frame is a unit structure, and the bottom of the side facing the turntable is hinged to the base.

Further, the lower front face of the column facing the turntable is connected to the column frame during delivery.

Further, the electric control door is rotatably connected with the column frame through a pin.

Further, the column panel that is detachably connected to the column comprises an access door, and the access door adopts a snap fit structure to be detachably connected to the column frame. Further, the access door adopts an inclined slot and a transverse bolt matching structure to be detachably connected to the column frame.

Further, the lifting mechanism or/and the mounting plate of the lifting film frame of the winding machine are connected with the column frame.

Further, the top cover of the column is connected with the column frame.

Another technical problem to be solved by the present invention is to provide a film feeding device applied in a winding machine, which can reduce the overall height of the film feeding device. Therefore, the present invention adopts the following technical scheme:

A film feeding device, comprising a film feeding frame, a film reel, a first roller and a second roller, and driving motors, wherein the first roller and the second roller are driven by their respective driving motors; the top of the film feeding frame is provided with an upper film frame structure, in which a transmission mechanism is arranged, and the first roller and the second roller are connected with respective drive motors through respective transmission mechanisms, and the drive motors are fixed under the upper film frame structure.

Further, the position of the first roller and the second roller is more biased toward the front side of the film feeding frame, the position of the driving motors is behind the first roller and the second roller, and the film reel is arranged on the film feeding frame on the film feeding side of the first roller.

Further, the position height of the driving motors corresponds to the position closer to the upper part behind the first roller and the second roller.

Further, the driving motors adopt AC motors.

Further, the transmission mechanisms adopt chain transmission mechanisms with deceleration function.

Further, a structure connected with the lifting device of the winding machine is arranged below the driving motors.

Further, the front side of the film feeding frame is provided with a film frame door, and the film frame door is connected with a film guide roller before the first roller, a film guide roller between the first roller and the second roller, and a film guide roller after the second roller.

Further, the first roller, the second roller and the film guide rollers are vertically arranged, and the lower end of the film frame door is hinged with the mounting frame.

The film feeding device of the present invention can reduce the overall height of the film feeding device, and can make use of the characteristics that the diameter of the film roll is generally larger than that of the first roller and the second roller, and the space needs to be reserved in the width direction to adapt to the diameter of the film roll, optimize the setting position of the driving motors, so as to effectively reduce the overall height of the film feeding load without increasing the size in the thickness direction of the film feeding device. Moreover, the structure of the present invention can adopt the AC drive motor, which is convenient for control, and can drive the first roller and the second roller separately, which can adjust and control the draw ratio of the main roller and the pre drawn roller in a large range. At the same time, it can obtain a larger adjustment range of the draw ratio only through small adjustment, and widely use films of various thicknesses, which has a wide range of use and is convenient for application, and the operation of penetrating film is simple and convenient.

DETAILED DESCRIPTION

Figure 1:
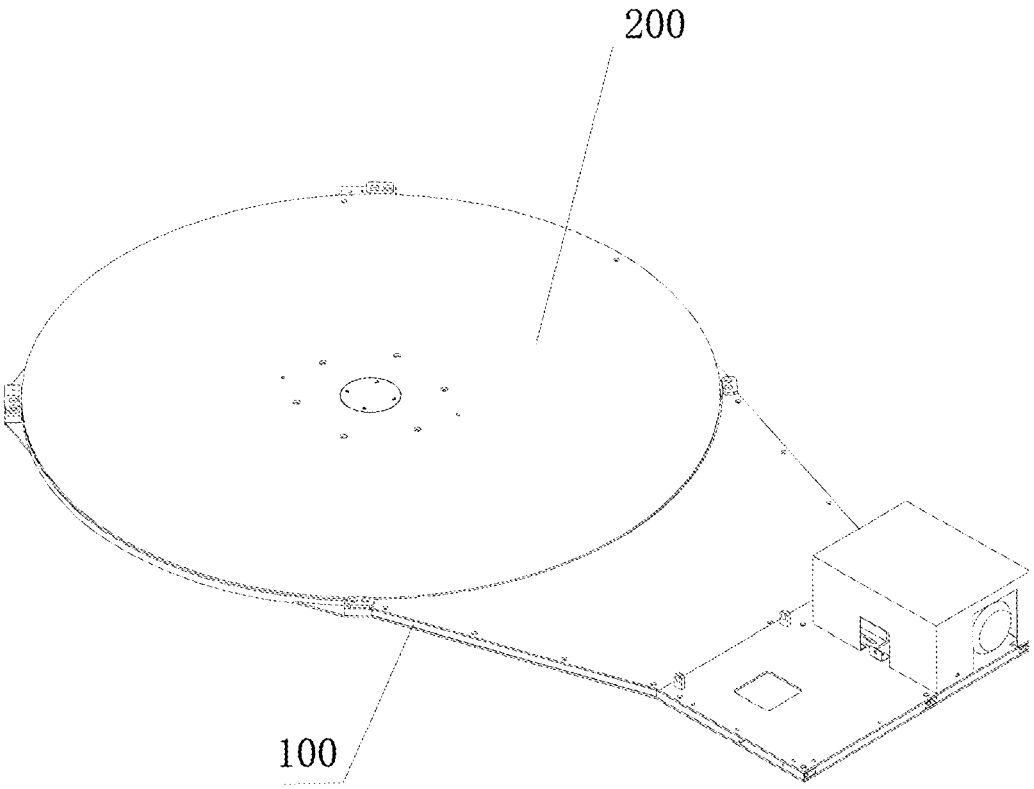
FIG. 1 is a schematic diagram of embodiment 1 provided by the present invention.
Figure 2:
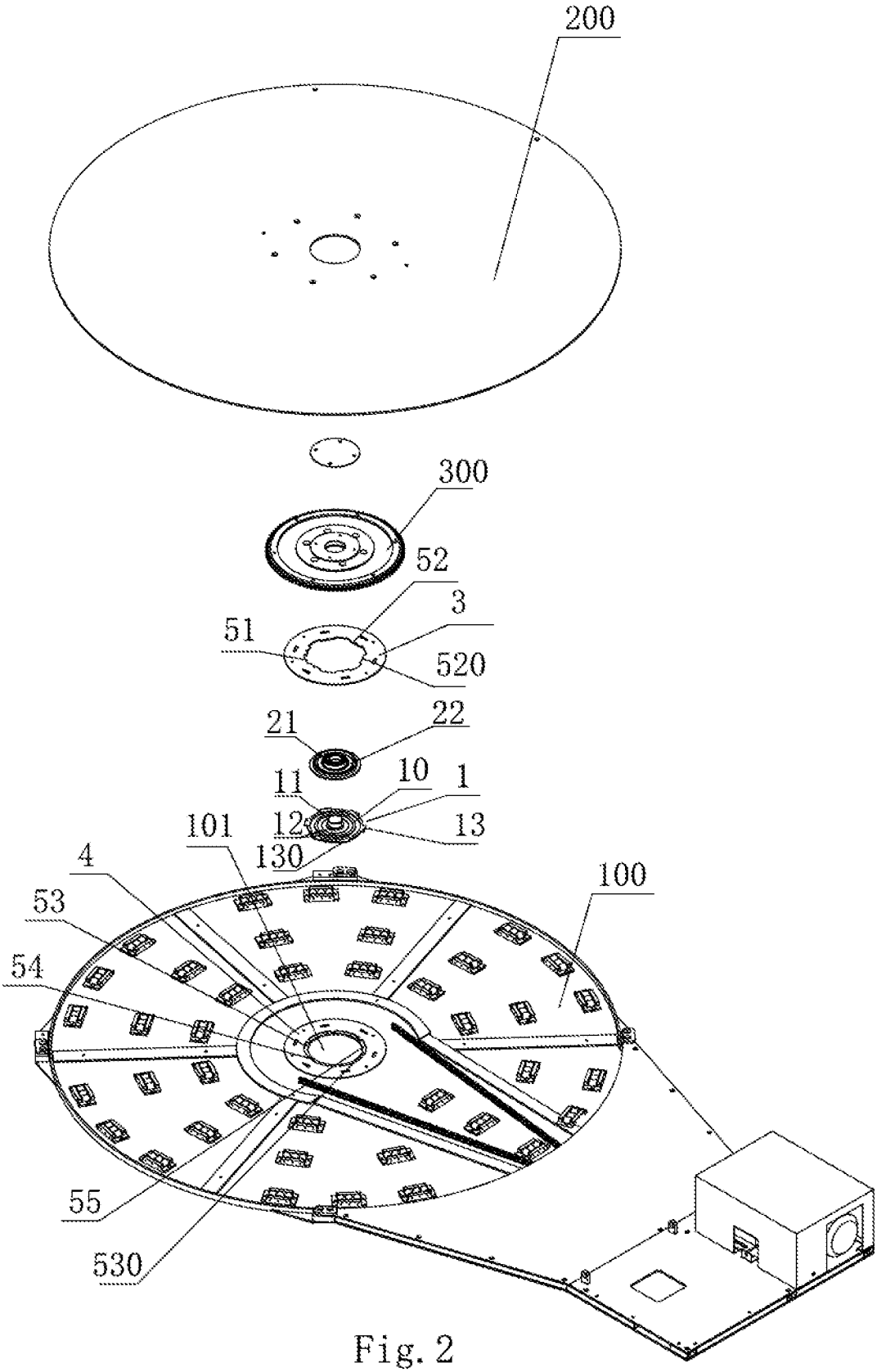
FIG. 2 is an exploded view of embodiments 1 and 2.
Figure 3:
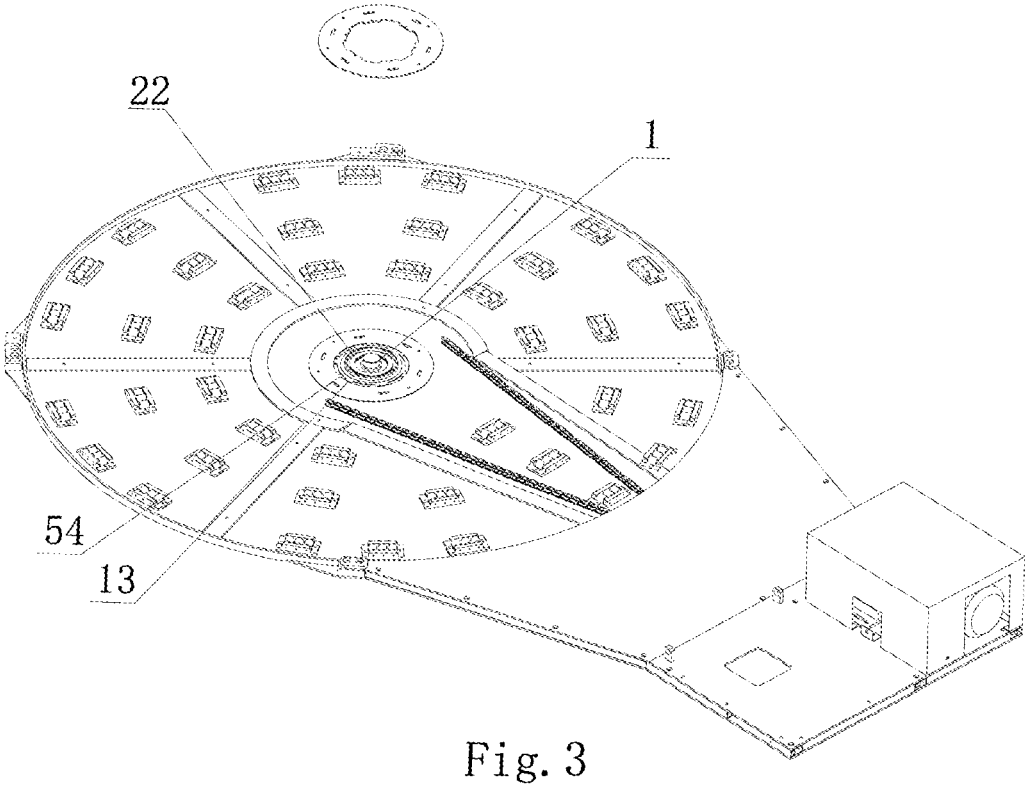
FIG. 3 is a schematic diagram when the central shaft components of the embodiments 1 and 2 are placed on the lower limiting component.
Figure 4:
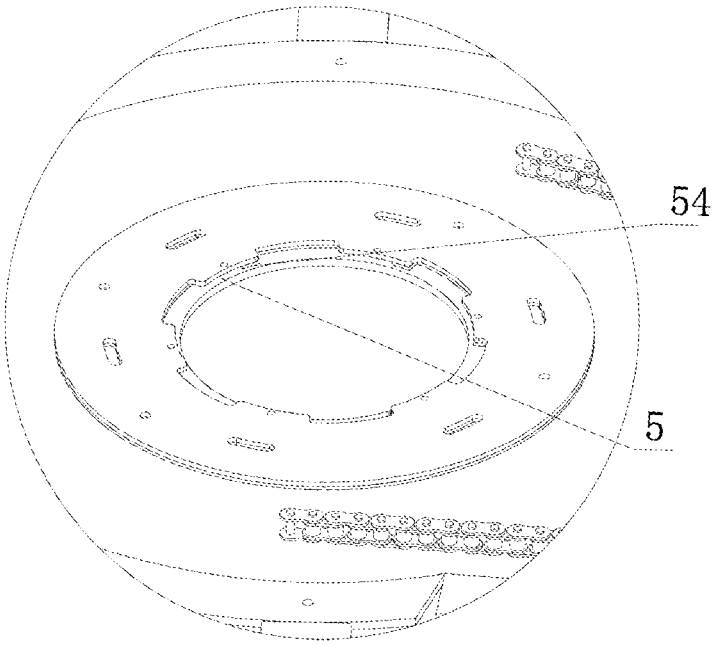
FIG. 4 is a partial enlarged sectional view of the embodiments 1 and 2.

For embodiment 1, refer to FIG. 1-4.

In the winding machine provided by this embodiment, its central shaft mechanism comprises a central shaft component 1, a base plate 10 and a central shaft 11 is projecting from the center of the base plate 10. In this embodiment, the winding machine is provided with two bearings formed on the base plate 10, which are the bearing 21 connected to the central shaft and the plane bearing 22 placed on the periphery of the bearing 21; the number and type of the bearings can be changed according to different situations, and the central shaft component is provided with a bearing support structure 12 of these bearings on the periphery of the central shaft 11. A plurality of first limiting structures 13 are also provided on the periphery of the central shaft component 1, and the central shaft component is fixed and is limited in the winding machine base by the first limiting structure 13. The limiting direction can be determined according to the rotation direction of the turntable 200 of the winding machine when winding the film on the articles as the forward direction, and the first limiting structure 13 is limited by the limiting structure in front of it.

A central shaft mechanism mounting hole 101 is provided in the winding machine base 100, and a connecting groove 5 is provided in the circumferential direction on the periphery of the central shaft mechanism mounting hole to form a limiting structure with a central shaft mechanism mounting hole. The open part faces the central shaft mechanism mounting hole 101, and the connecting groove has an open part 51 for the first limiting structure 13 to be inserted; the central shaft mechanism mounting hole 101 and the open part part form a central shaft component insertion hole. By rotating the central shaft component 1, the first limiting structure 13 can be clamped between the upper groove wall 52 and the lower groove wall 53 of the connecting groove, and the first limiting structure 13 is connected to the upper groove wall 52 and the lower groove wall 53 of the connecting groove as a whole by bolts. For the first limiting structure 13, the upper groove wall 52 and the lower groove wall 53 are all prefabricated with bolt holes, and the bolt holes of the lower groove wall 53 are threaded connection holes.

The connecting groove can adopt a three-layer structure, which is not only reliable in connection with the central shaft component, convenient in installation, but also suitable for thin design, which helps to reduce the height of the turntable of the winding machine.

The central shaft mechanism is provided with an upper limiting structure 3, as the upper structure, and the upper limiting structure 3 is a ring-shaped structure, whose inner side has a plurality of keys protruding inward, which form an upper groove wall limiting the first limit structure; the interval between the keys constitutes the open part 51, the central hole of the ring structure forms the central insertion hole, and the upper limiting structure is made of metal plate; the upper limiting structure 3 is made of metal plate.

The central shaft mechanism is provided with a middle limiting structure 4, as a middle structure, and the middle limiting structure 4 is a ring-shaped structure, forming the groove bottom 55 of the connecting groove; a plurality of keys protruding inward are arranged on the inner side, and the key serves as a limiting structure in front of the first limiting structure (according to the direction of rotation of the turntable 200 when the winding machine winds the film on the article as the forward direction). It is named the second limit structure 54. When the first limiting structure 13 is blocked by the second limiting structure 54, the first limiting structure 13 is clamped between the upper and lower groove walls 52 and 53 of the connecting groove, and the bolt holes 130 on the first limiting structure 13 are aligned with the bolt holes 520 and 530 on the upper and lower groove walls 52 and 53. In this way, in the installation site, as long as the central shaft component 1 is placed into the central shaft component insertion hole, and then rotated to the first limiting structure 13 to touch the second limiting structure 54, it is directly fixed with bolts. The central shaft component 1 is clamped in the connecting groove 5, and the installation is very reliable and not easy to deform. The middle limiting structure is also made of metal plate.

As a lower structure, the lower groove wall can directly adopt the base 100.

The upper limiting structure 3 and the middle limiting structure 4 can be fixedly connected with the lower groove wall by bolts or welding.

The central shaft mechanism can be connected with sprocket 300, which the chain drives the sprocket 300 to rotate, the sprocket 300 is supported by the bearing in the central shaft mechanism, and the turntable 200 and the sprocket 300 are connected and driven to rotate. The sprocket 300 may not be set separately, and the chain teeth may be set by the turntable 200, which is supported by the bearing in the central shaft mechanism and driven to rotate by the chain.

For embodiment 2, refer to FIGS. 5 and 6, and FIGS. 2, 3 and 4.

The thin winding device provided by the embodiment comprises a turntable 200, a base 100 and a chain transmission mechanism. The turntable 200 can be rotatably installed on the base 2, and the thickness between the top surface of the turntable and the bottom surface of the base (the support bottom surface) is greater than or equal to 24 mm and less than 36 mm.

The winding device is provided with a central bearing device on the base, and the central bearing device is provided with two bearings, namely a first bearing 21 connected with the central shaft 11 and a plane bearing 22 placed on the periphery of the first bearing. The central bearing device can be connected with sprocket 300, the chain drives the sprocket 300 to rotate, the sprocket 300 is supported by the bearing in the central bearing device, and the turntable 200 and the sprocket 300 are connected and driven to rotate. The sprocket 300 may not be set separately, and the chain teeth may be set by the turntable 200, which is supported by the bearing in the central bearing device and driven to rotate by the chain.

The central bearing device of the present invention also comprises a central shaft component 1, a central shaft 11 is arranged in the central part of the central shaft component 1, and a bearing support structure 12 of these bearings is arranged on the periphery of the central shaft 11 of the central shaft component. The periphery of the central shaft component 1 is also provided with a plurality of first limiting structures 13. The central shaft component is fixed and limited in the base of the winding machine through the first limiting structure 13. The limiting direction can be determined according to the rotation direction of the turntable 200 of the winding machine when winding the film on the articles as the forward direction, and the first limiting structure 13 is limited by the limiting structure in front of it. The central bearing device of the present invention has stable position, stable and reliable operation, and can reduce the working noise and noise during operation.

A central bearing device mounting hole 101 is arranged in the winding machine base 100, and a connecting groove 5 is arranged along the circumference of the central bearing device mounting hole to form a limiting structure with a central bearing device mounting hole. The notch of the connecting groove 5 faces the central bearing device mounting hole 101, and the connecting groove has an open part 51 for the first limiting structure 13 to place. The installation hole 101 and the open part form a central shaft component placing hole. By rotating the central shaft component 1, the first limiting structure 13 can be clamped between the upper groove wall 52 and the lower groove wall 53 of the connecting groove, and the first limiting structure 13 is connected with the upper groove wall 52 and the lower groove wall 53 of the connecting groove as a whole by bolts. For the first limiting structure 13, the upper groove wall 52 and the lower groove wall 53 are all prefabricated with bolt holes, and the bolt holes of the lower groove wall 53 are threaded connection holes.

The connecting groove can adopt a three-layer structure, which is reliable in connection with the central shaft component and convenient in installation.

The center bearing device is provided with an upper limiting structure 3 as an upper structure. The upper limiting structure 3 is a ring-shaped structure with a plurality of keys protruding to the inner side. The keys form an upper groove wall limiting the first limiting structure. The interval between the keys forms the open part 51. The central hole of the ring-shaped structure forms the central insertion hole. The upper limiting structure is made of a metal plate, and the upper limit structure 3 is made of a metal plate.

The center bearing device is provided with a middle limiting structure 4 as a middle structure, which is a ring-shaped structure to form the groove bottom 55 of the connecting groove, and the inner side of which is provided with a plurality of keys protruding inward. The keys are used as a limiting structure in front of the first limiting structure (according to the forward direction of the turntable 200 when the winding machine winds the film onto the articles), and the limiting structure is named as the second limiting structure 54. When the first limiting structure 13 turns to be blocked by the second limiting structure 54, the first limiting structure 13 is clamped between the upper and lower groove walls 52 and 53 of the connecting groove, and the bolt holes 130 on the first limiting structure 13 are aligned with the bolt holes 520 and 530 on the upper and lower groove walls 52 and 53. In this way, in the installation site, as long as the central shaft component 1 is put into the central shaft part insertion port, and then rotated to the first limiting structure 13 to touch the second limiting structure 54, it is directly fixed with bolts. The central shaft component 1 is clamped in the connecting groove 5, so the installation is very reliable and not easy to deform. The middle limiting structure is also made of a metal plate.

As a lower structure, the lower groove wall can directly adopt the base 100.

The upper limiting structure 3 and the middle limiting structure 4 can be fixedly connected with the lower groove wall by bolts or welding.

Figure 6:
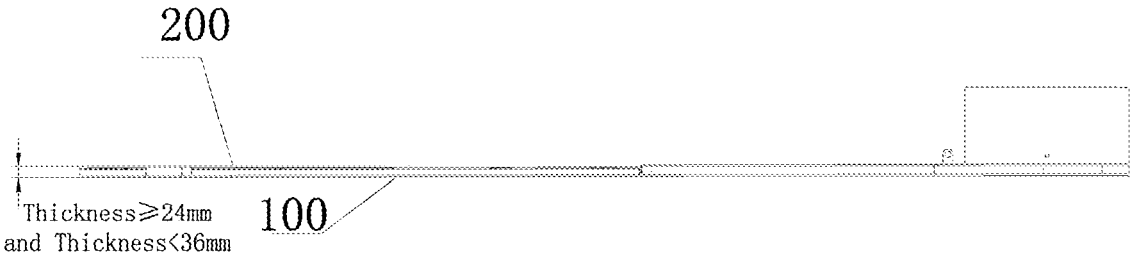
FIG. 6 is a side view of embodiments 2, 3, 4 and 5 of the present invention.
Figure 7:
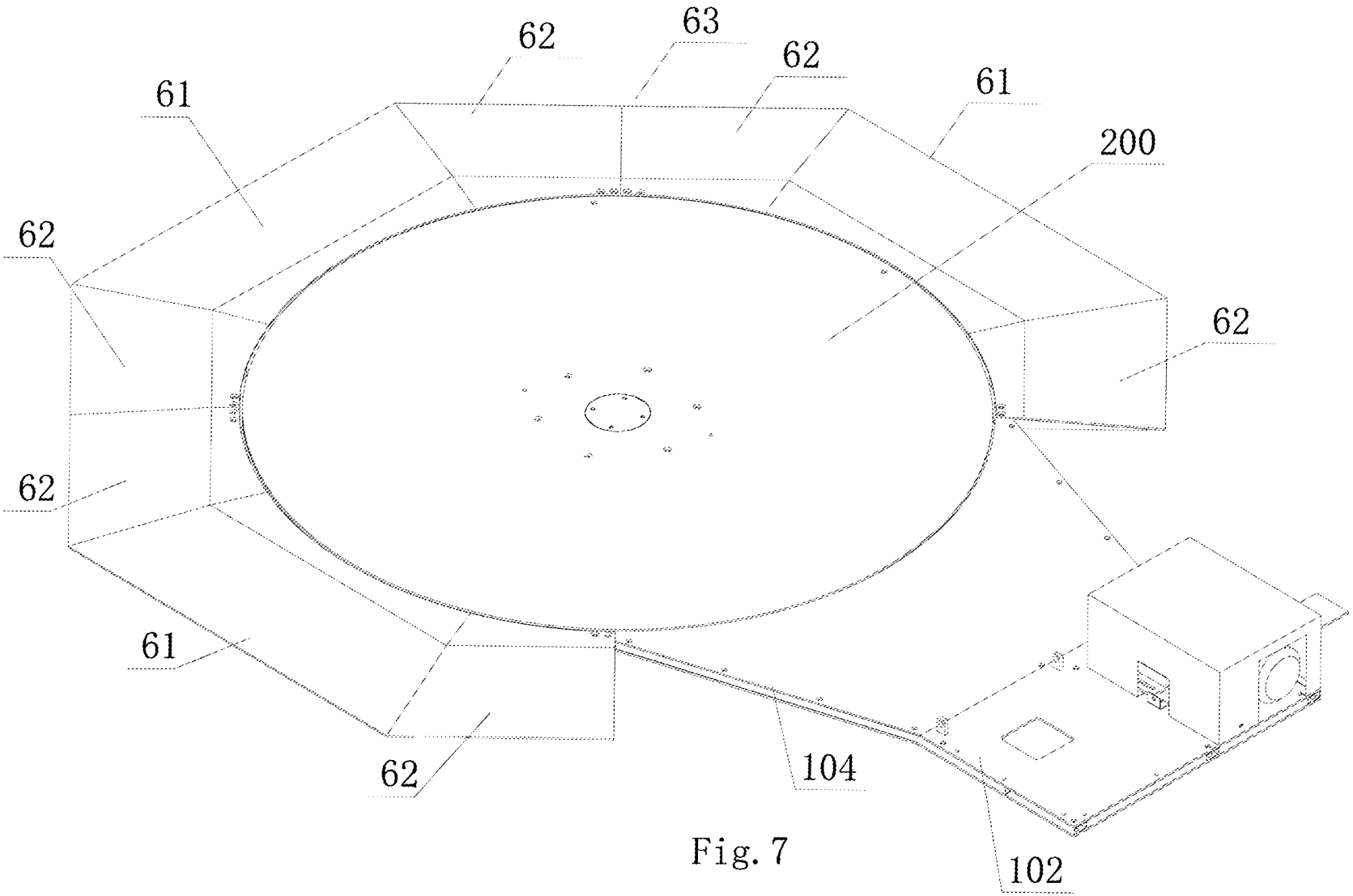
FIG. 7 is a schematic diagram of the embodiment 3 of the present invention.
Figure 8:
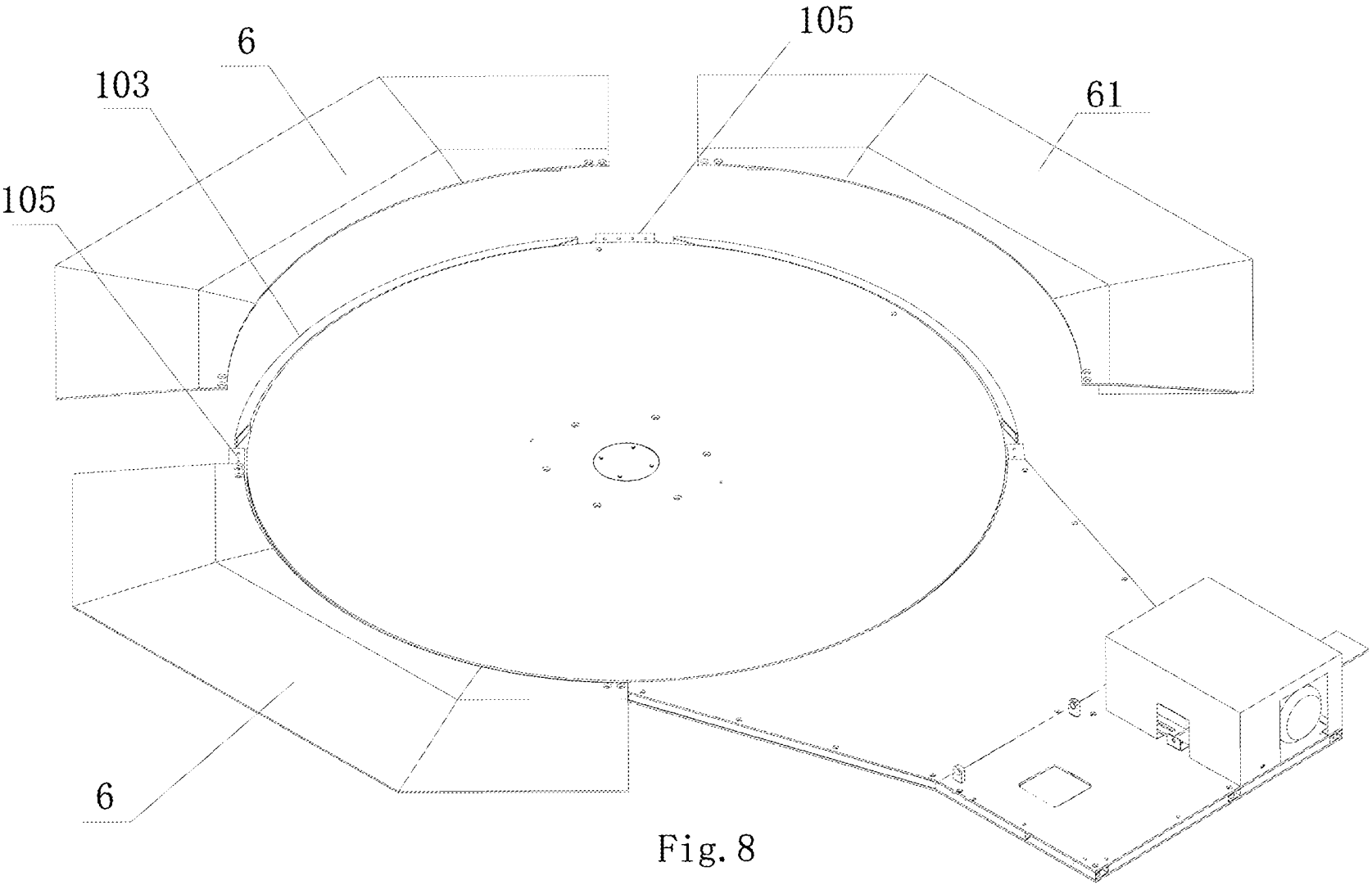
FIG. 8 is an exploded view of the embodiment 3.
Figure 9:
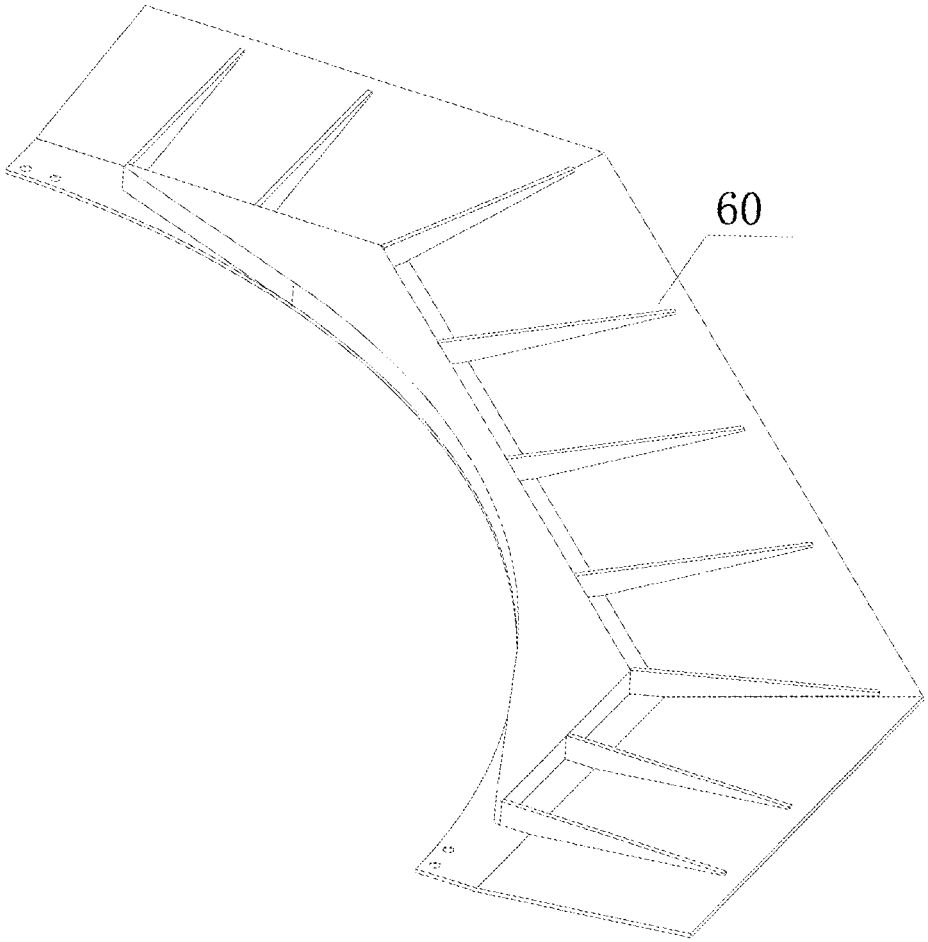
FIG. 9 is a schematic diagram of the bottom of the partitioned slope in the embodiment 3.
Figure 10:
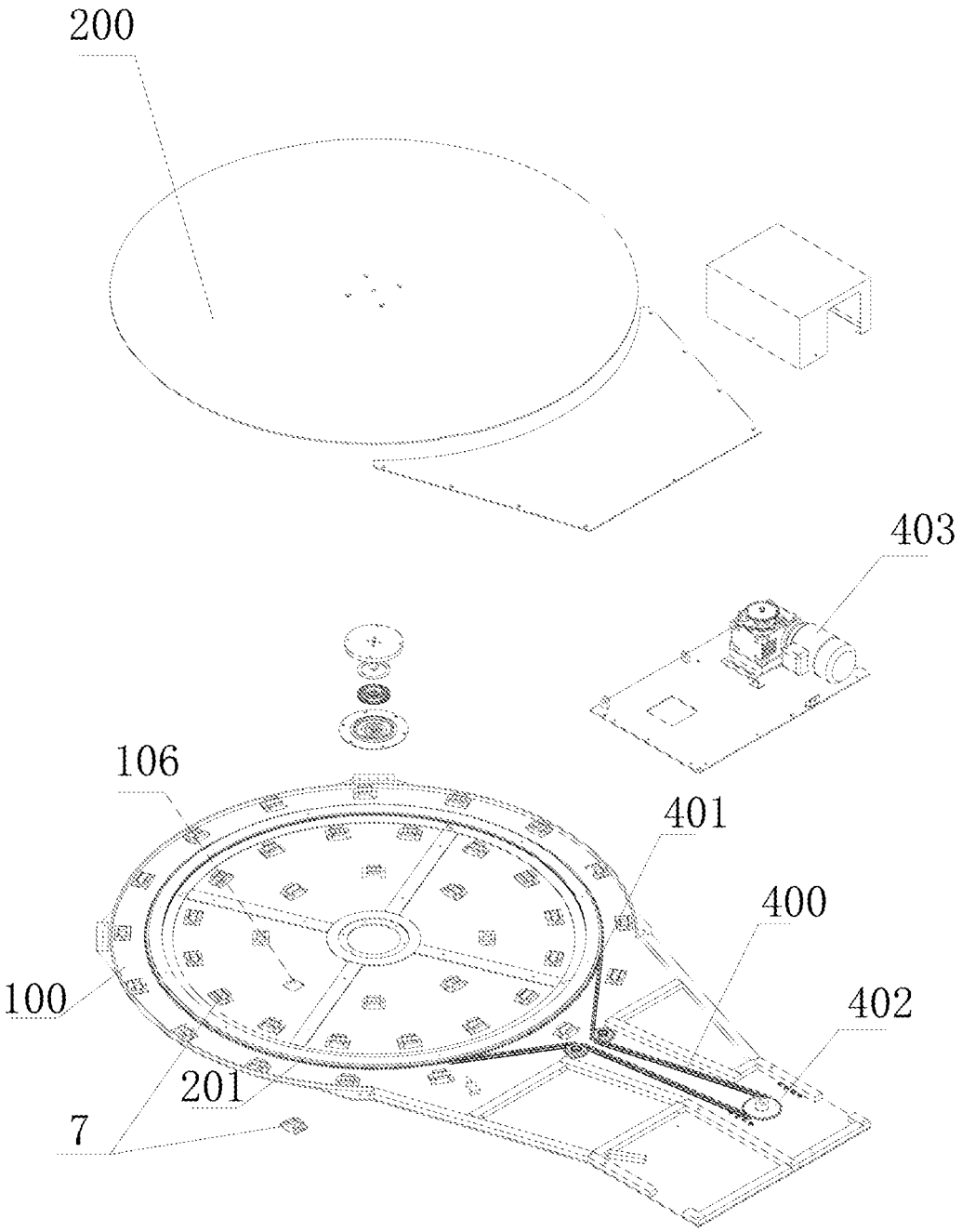
FIG. 10 is an exploded view of the embodiment 4 of the present invention.
Figure 11:
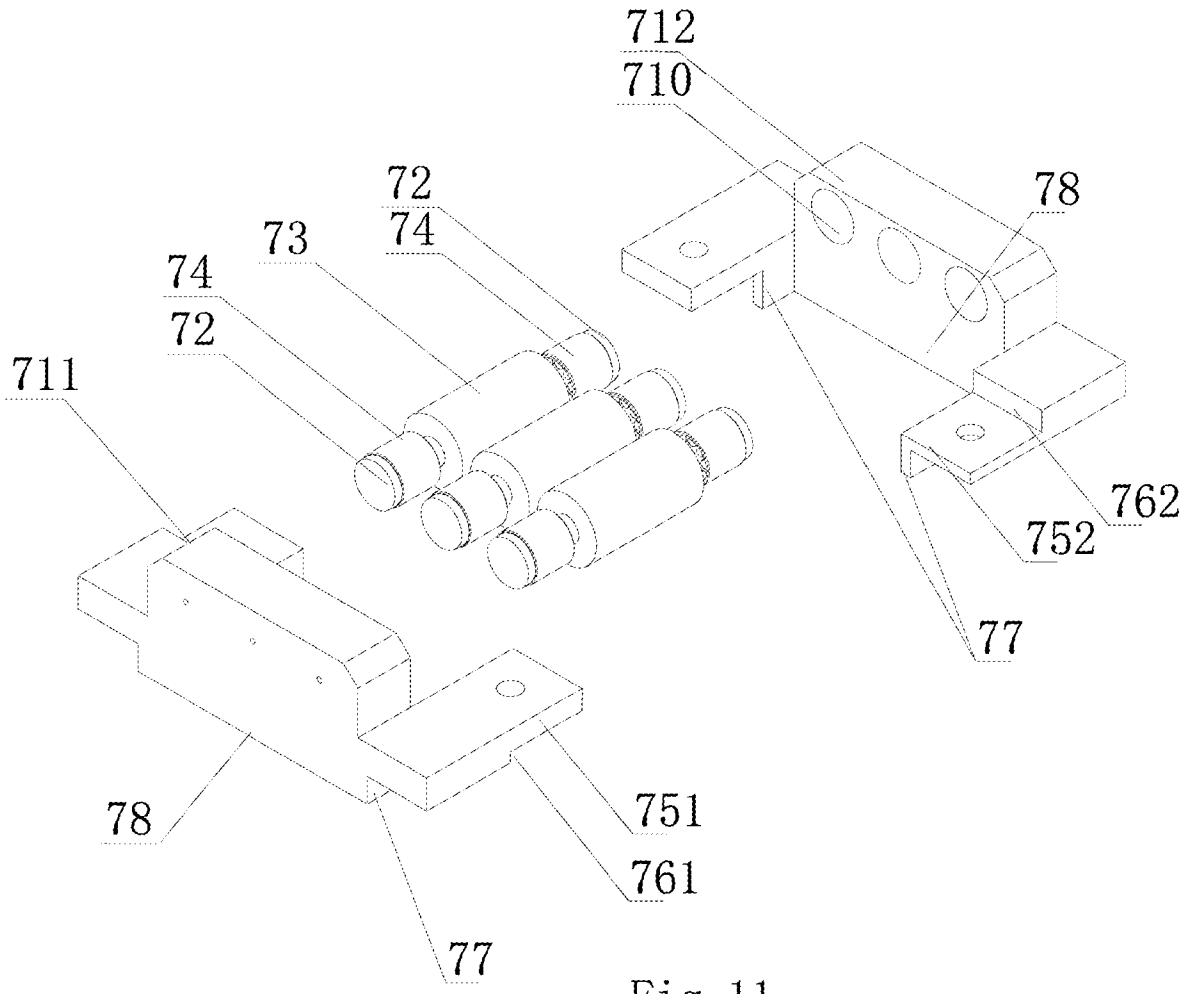
FIG. 11 is an exploded view of the roller mechanism of the embodiment 4 of the present invention.
Figure 12:
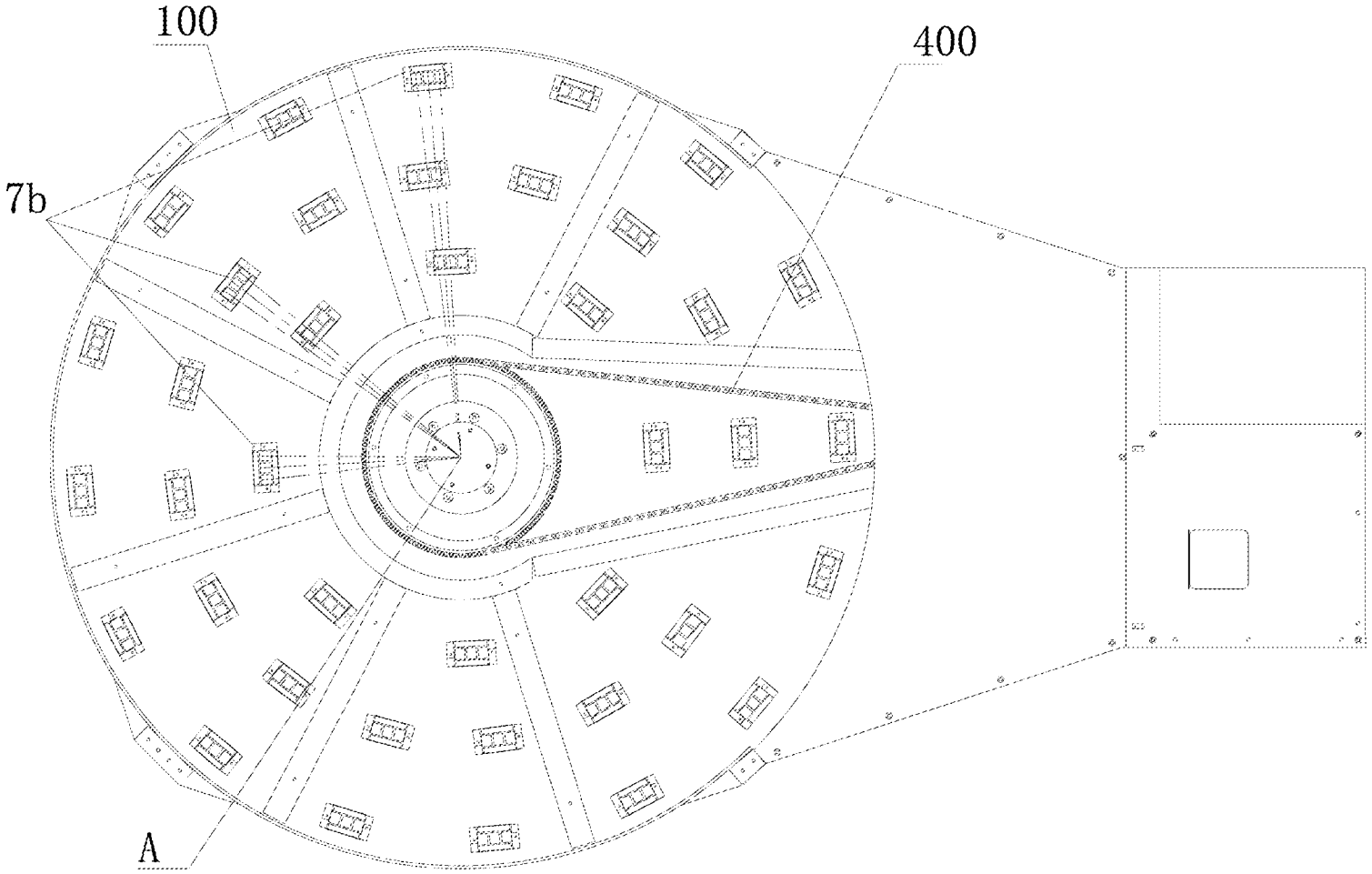
FIG. 12 is a top view of the embodiment 5 of the present invention after the turntable is hidden.
Figure 13:
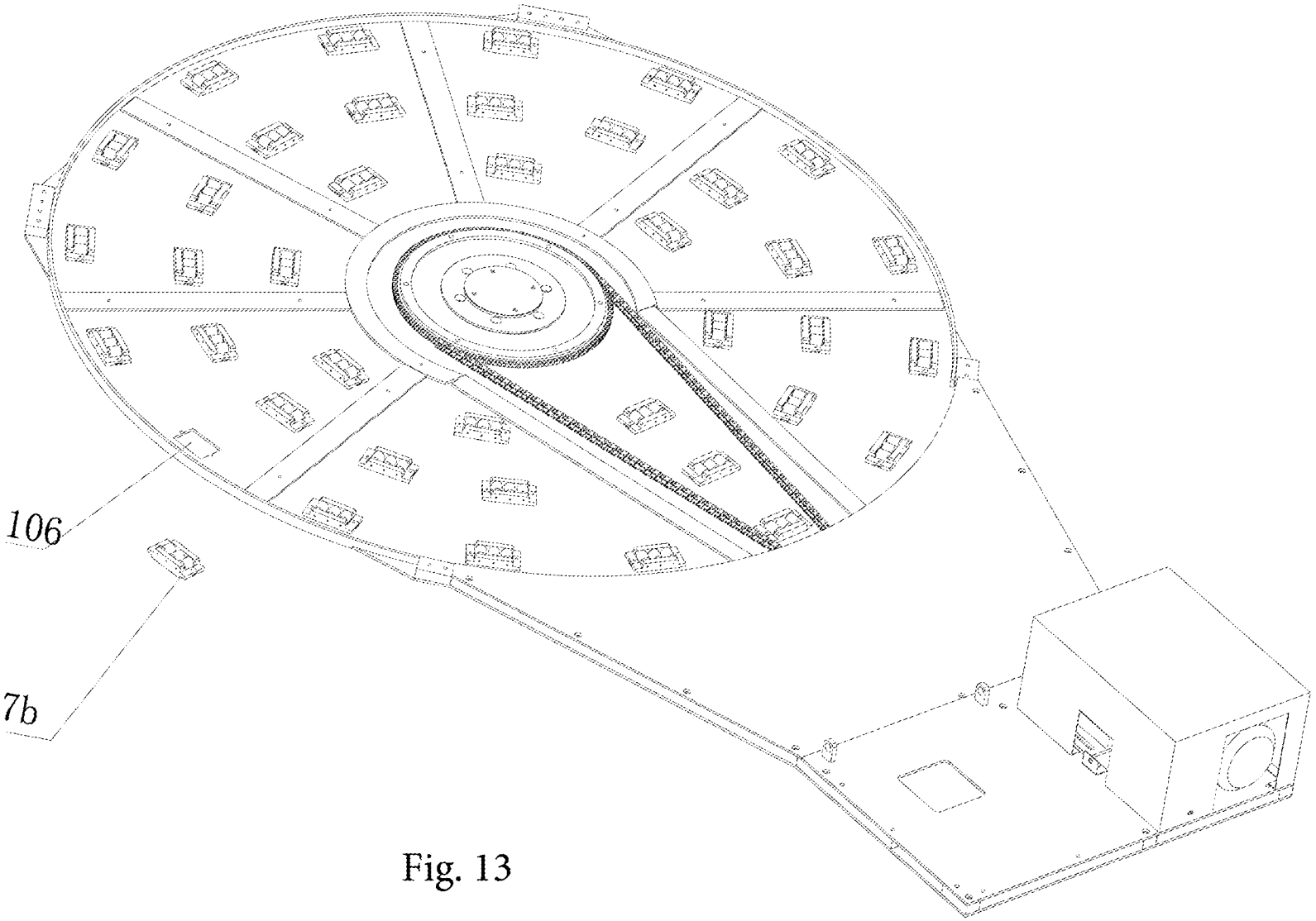
FIG. 13 is a local explosion diagram of the embodiment 5 of the present invention after the turntable is hidden.
Figure 14:
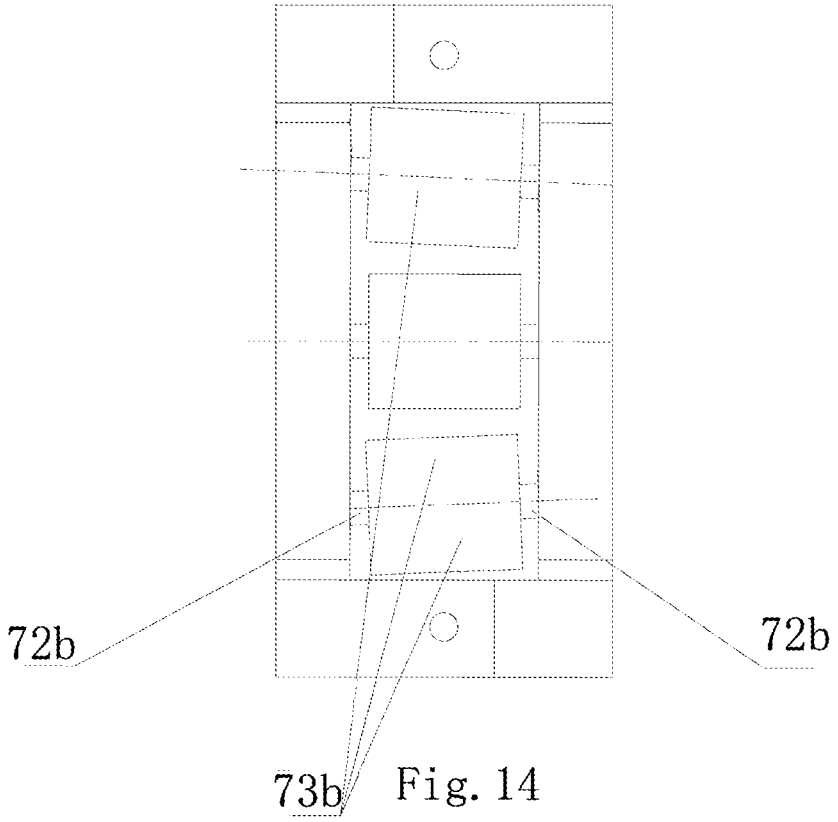
FIG. 14 is an enlarged top view of the roller set of the embodiment 5.
Figure 15:
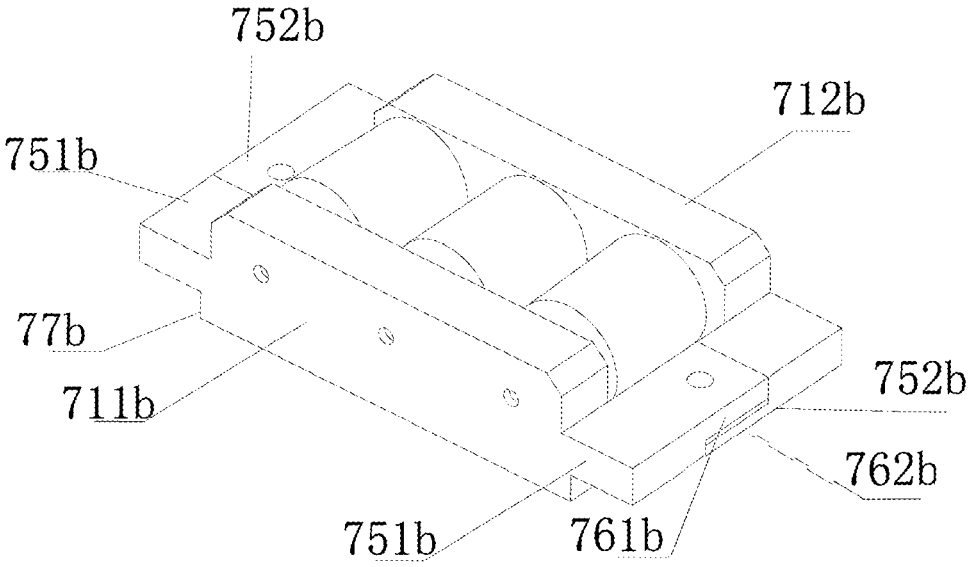
FIG. 15 is a stereoscopic enlarged view of the roller set of the embodiment 5.

FIG. 6 is the transition slope outside the winding device.

For embodiment 3, refer to FIGS. 7, 8, 9 and FIG. 6.

The turntable slope mechanism of the winding machine provided by this embodiment includes a base 100, which comprises a first end portion 102 connected with the column at one end, a second end portion 103 supporting the turntable 200 at the other end, and a connecting part 104 between the first end portion 102 and the second end portion 103.

A slope of the turntable is arranged on the periphery of the other side of the second end portion 103 except the side connected with the connecting part. The slope is detachably connected with the base, and the slope is composed of three partitioned slopes 6 along the circumference of the second end portion. The sizes of the slopes of the three partitioned slopes are basically the same.

Each partitioned slope 6 has a main slope side 61 corresponding to one side of the turntable. The two ends of the main slope side are provided with a splicing slope side 62 at a certain angle with the main slope side, and a slope side 63 is composed of the adjacent partitioned slopes 6 by the splicing slope sides 62 on this side. In this way, the overall shape of the outside of the slope is basically the partial shape of a polygon. At the same time, the splicing slope side at one end of the main slope side also forms the slope side at the back of the turntable (both sides of the connecting part 104), which basically realizes the moving of the articles without dead angle.

The height from the bottom of the winding machine to the upper surface of the turntable is greater than or equal to 24 mm and less than 36 mm.

The slope surface of the partitioned slope 6 can be composed of steel plates, and a plurality of stiffeners 60 can be arranged on the back of the partitioned slope 6. For the detachable connection, bolt connection, pin connection and other methods can be adopted, and a number of bolt connection positions 105 or pin holes are arranged around the second end portion 103 of the base, which the partitioned slope 6 is detachably connected to the base by bolts or pins.

For embodiment 4, refer to FIGS. 5, 6, 10, 11.

The thin winding machine applied to the roller mechanism provided by the embodiment includes a turntable 200, a base 100 and a chain transmission mechanism 400. The turntable 200 can be rotatably mounted on the base 100, and a driven sprocket of the chain transmission mechanism is arranged on the back of the turntable 200. The driven sprocket can use a ring sprocket 401, and the ring sprocket 401 takes the rotation center of the turntable 200 as its rotation center, which the thickness between the top surface of the turntable and the bottom surface of the base is greater than or equal to 24 mm and less than 36 mm.

Reference number 402 is the driving sprocket of the chain drive mechanism, and reference 403 is the driving motor of the chain drive mechanism.

A connecting plate 201 is arranged on the bottom surface of the turntable 200, the turntable 200 is fixedly connected with the connecting plate 201, the ring sprocket 401 is under the connecting plate 201, and the ring sprocket 401 is fixedly connected with the connecting plate 201. This scheme is helpful to the thin design of the turntable 200 and the sprocket under the condition of ensuring the strength. The connecting plate 201 can also be in a ring shape. The connecting plate 201 is welded with the turntable 200, and the ring sprocket 401 is welded with the connecting plate 201.

The winding machine is provided with a plurality of roller mechanisms 7 of the present invention distributed on the upper surface of the base, and the roller mechanism is installed on the base 100; the roller assembly includes a roller frame, integral rollers 73 with shafts 72 on both sides, and bearings 74, which are located on the shafts 72 on both sides of the roller 73 and in the bearing holes 710 of the roller frame, which is beneficial to the thinning design of the winding machine.

The roller frame is formed by connecting the left and right separated components 711 and 712, which is convenient for the installation of the integral rollers 73 and the bearings 74 with the shafts 72 on both sides. The left and right separated components 711 and 712 are provided with matching connecting arms 751 and 752, the ends of the connecting arms 751 and 752 of the left and right separated components are provided with steps 761 and 762, and the connecting arms of the left and right separated components are coupled through the end steps and fixed together by screws. The connection is reliable and the size in the height direction can be reduced.

The roller frame is provided with a structure 77 which is positioned and matched with the mounting hole 106 on the base 100. The positioning structure 77 of the roller frame is also a part of the insertion structure 78 which is matched with the mounting hole 106 at the lower part of the roller frame, and sunk into the mounting hole 106 together with the insertion structure, which is stable and can reduce the height.

The roller 73 is located above the open part of the mounting hole 106, that is, the lower edge of the roller 73 does not fall into the mounting hole 106 in height. In this way, when the height of the whole base is reduced and the height of the turntable 200 is reduced, the mounting height of the roller 73 can be guaranteed to be reduced, and at the same time, stones and other debris on the bottom surface can be prevented from being brought in when the roller rotates.

Preferably, the height of the roller 73 from the support plane of the base 100 (which can be understood as the bottom surface or the plane supporting the base) is greater than 0.7 cm and less than or equal to 2.5 cm.

The roller mechanism is provided with a plurality of mutually parallel integral rollers 73 with shafts 72 on both sides.

Reference number 6 is the transition slope outside the winding machine.

Figure 5:
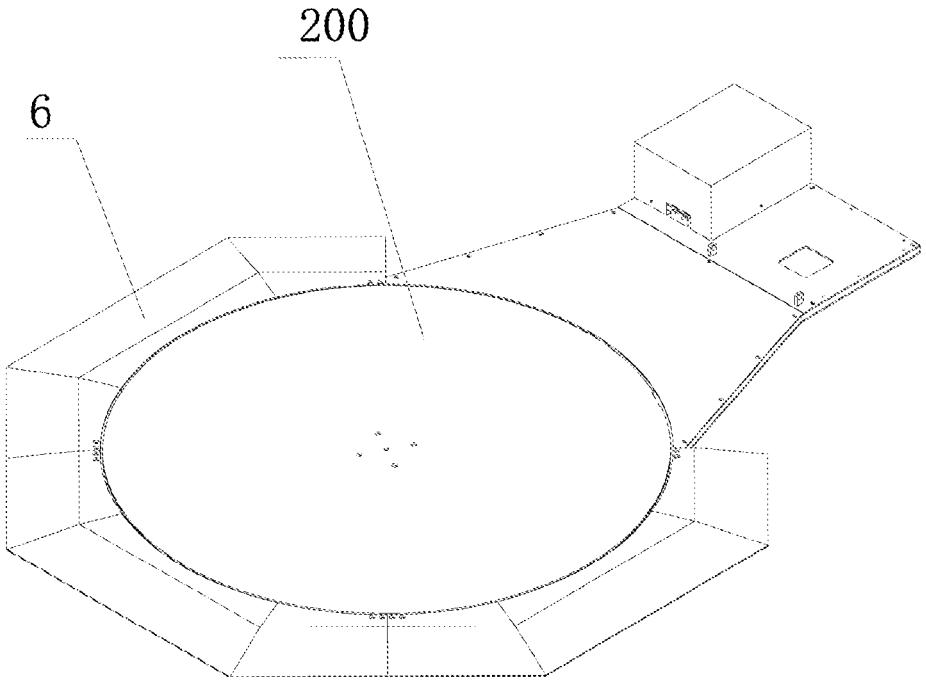
FIG. 5 is a schematic diagram of embodiments 2, 4 and 5 of the present invention.

For embodiment 5, refer to FIGS. 12-15, and also refer to FIGS. 5 and 6.

The winding machine used in this embodiment comprises a turntable 200, a base 100 and a chain transmission mechanism 400. The turntable 200 is rotatably mounted on the base 100, and a roller set **7*b* is arranged on the base 100**.

The present invention takes the rotation center A of the turntable as the center, and is provided with a plurality of roller sets, in which several rollers **73*b* are arranged, and the number of rollers in each set is preferably 2-5. The back of the turntable 200** is supported on the rollers of the roller set.

The axis of the roller 73*b* in the roller set is arranged radially relative to the rotation center, and the structure of the present invention does not have deviated wear, which is very beneficial for reducing the installation height of the rollers 73*b*.

The roller sets 7*b* are arranged in circles with the rotation center A as the center according to the radius of the position, and a plurality of roller sets 7*b* are arranged in each circle.

The rollers in the roller set can adopt integral rollers 72*b* with shafts on both sides, and the roller set comprises a roller frame, integral rollers and bearings. The roller frame is formed by connecting the left and right separated components 711*b* and 712*b*, which is convenient for the installation of the integral rollers 72*b* with the shafts on both sides. The left and right separated components 711*b* and 712*b* are provided with matching connecting arms 751*b* and 752*b*, and the ends of the connecting arms 751*b* and 752*b* of the left and right separated components are provided with steps 761*b* and 762*b*. The connecting arms of the left and right separated components are coupled through the steps at the ends and are fixed together with screws, which can not only connect reliably, but also reduce the size in the height direction.

The roller frame is provided with a structure 77*b* which is positioned and matched with the mounting hole 106 on the base 100, and the positioning structure 77*b* of the roller frame is also a part of the insertion structure which is matched with the mounting hole 106 at the lower part of the roller frame, and sunk into the mounting hole 106 together with the insertion structure, which is stable and can reduce the height.

For embodiment 6, refer to FIGS. 16-20.

Figure 16:
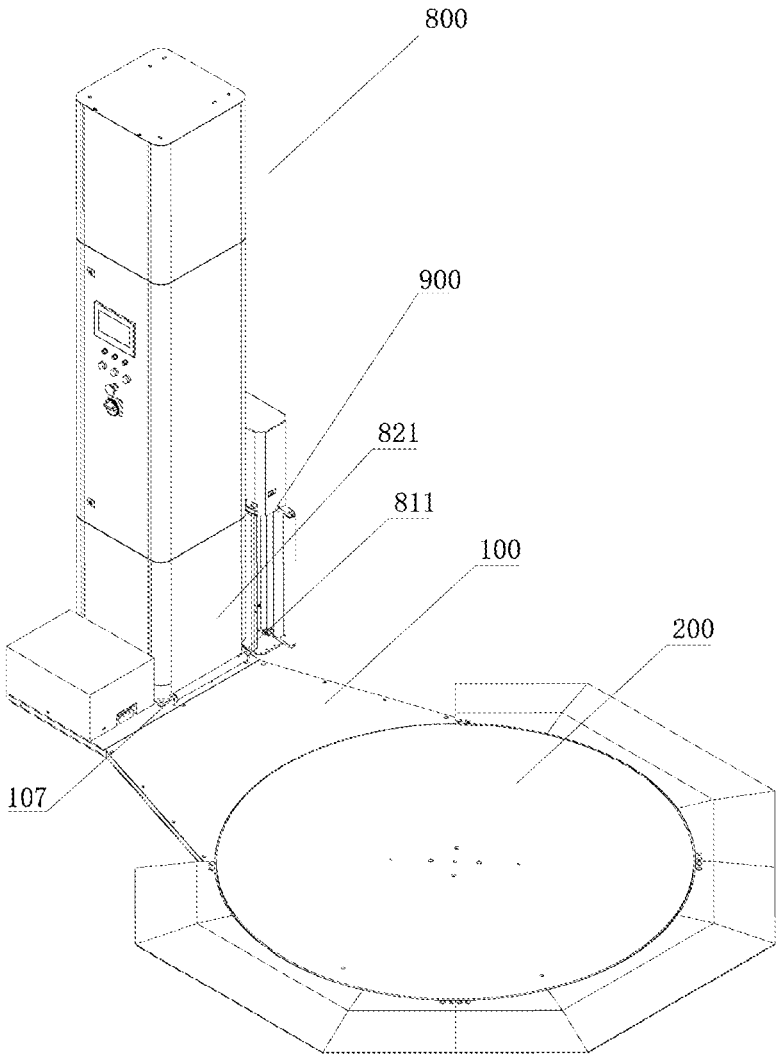
FIG. 16 is a schematic diagram of embodiment 6 of the present invention.
Figure 17:
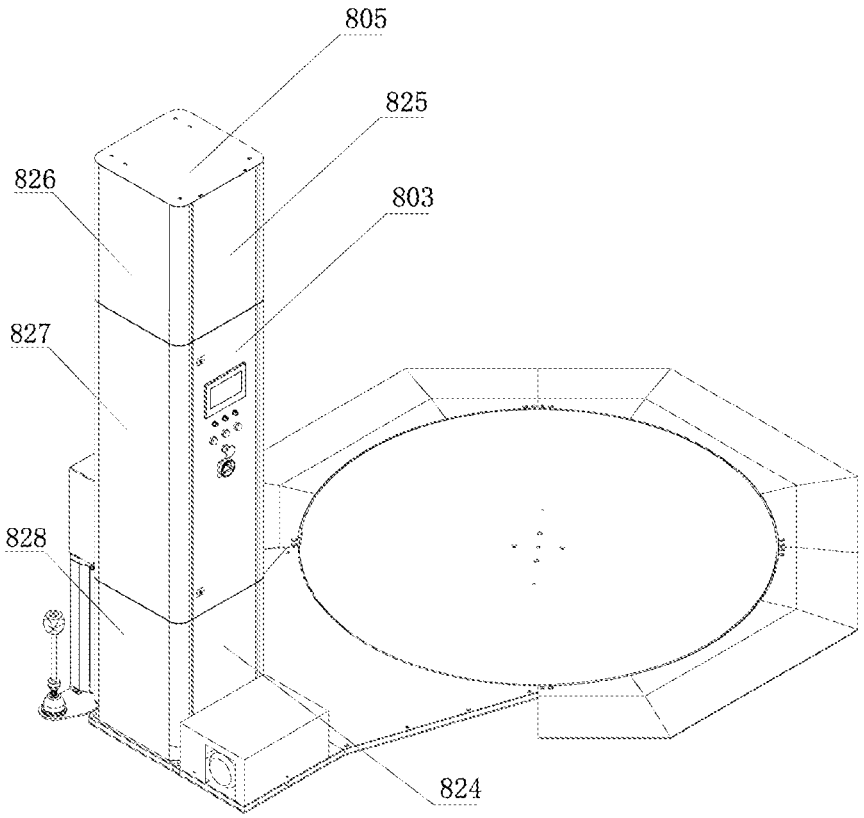
FIG. 17 is a schematic diagram from another angle of embodiment 6 of the present invention.
Figure 18:
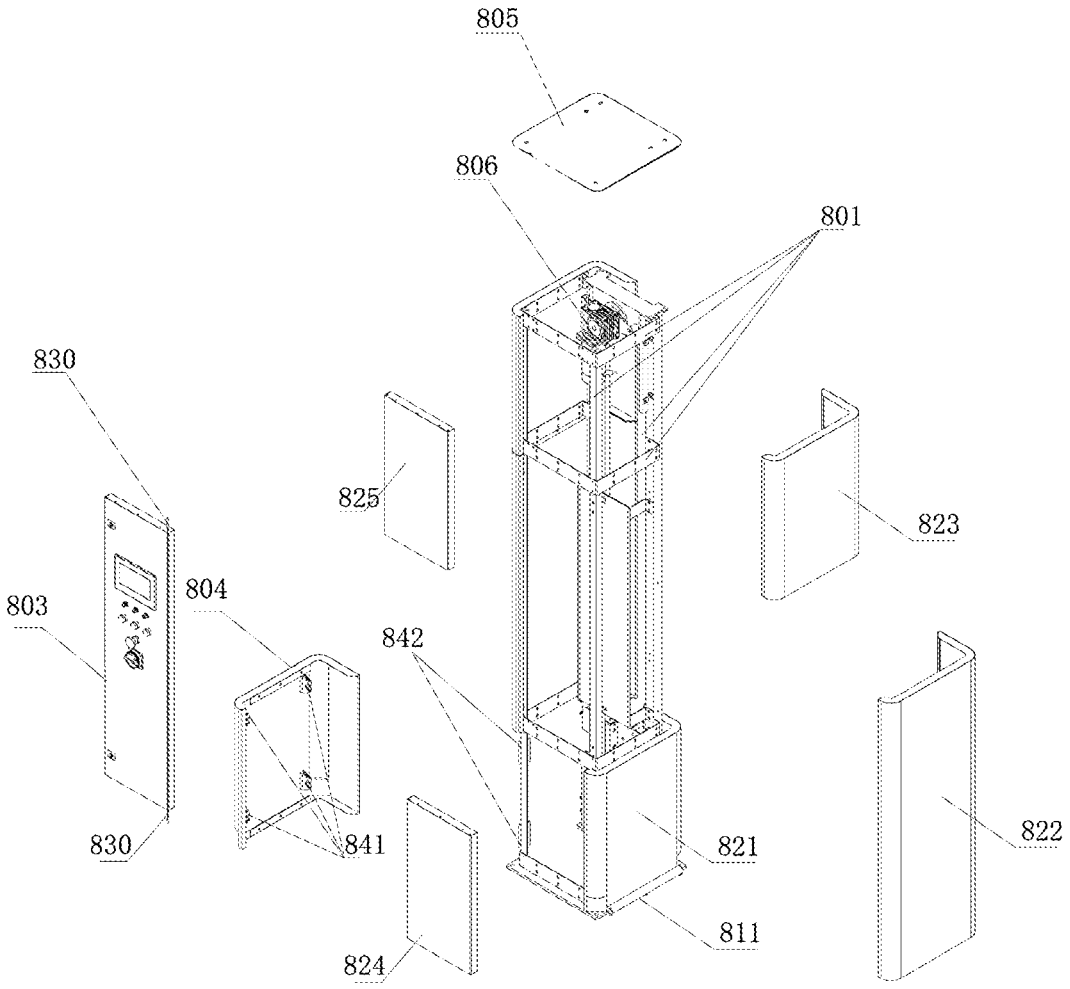
FIG. 18 is an exploded view of the embodiment 6 of the present invention.

Refer to FIGS. 16-18, the column mechanism provided by the present invention is a part of the winding machine, and comprises a column 800, a base 100 and a turntable 200. The column 800 comprises a column frame 801.

The column frame can be assembled by metal parts with certain rigidity and strength which can bear the weight. The column also comprises a plurality of column panels, at least a part of which is detachable and connected with the column frame. During transportation, there is a way that these panels can be removed from the column frame 801 and packaged properly, so they will not be damaged during transportation. However, in the use site, the column assembly can be completed by simply attaching to the column frame 801, without complex column assembling work. Even if the panel is not disassembled during transportation, in case of collision, it is only a partial replacement of the panel, which will not cause the whole column to be scrapped and save the cost.

As for the column frame, it is not easy to be knocked to damage the appearance, even if it is knocked, it is not easy to deform. If the winding machine removes the panel for transportation, even if the column frame has partial appearance damage, it has little or no impact on the column shape.

Further, the column frame 801 itself is a unit structure, which forms a whole and is suitable for hinged connection with the base. In this way, the column frame 801 can be pre-installed on the base 100 in the same way as the previous column in the form of rotatable connection, which is convenient for transportation and more convenient for field installation. The rotatable connection position of the column frame can be at the bottom of the side facing the turntable 200 and hinged through the tubular member 811 and the horizontal pin 107 on the base.

For the column panels, all column panels can be detachably connected with the column frame. Even so, it is not necessary to remove some panels that are not easy to be bumped or will be covered by some winding machine parts during transportation (these panels do not have to be detachably connected with the column frame), for example, the panel 821 at the lower part of the column facing the turntable can be connected to the column framework 801 when shipped from the factory. For another example, the panel that will be covered by the lifting film frame 900 does not have to be removed.

The detachable connection can be various mechanical connection structures such as screw, buckle connection, clamping connection, pin connection, etc.

The column panels detachably connected with the column frame includes an electric control door 803, which is equipped with buttons, indicator lights, etc. Generally, some electrical devices are installed on the back of the electric control door, and the electric control door 803 can be rotatably connected with the column frame through pins 830.

The column panels detachably connected with the column frame comprises an access door 804, and the access door 804 is detachably connected with the column frame 801 by adopting an inclined slot 841 and a transverse bolt 842 matching structure, which is convenient for opening and closing, and has no interference during maintenance.

If the locks are required for the doors 803 and 804, the locks of the conventional structure can be directly locked on the column frame 801.

The top cover 805 of the column is connected with the column frame 801, and the connection mode can also adopt screw connection.

The lifting mechanism 806 of the winding machine's lifting film frame 900 is connected with the column frame. Compared with the past, the lifting mechanism is not easy to deform and deviate from the position, and the lifting work is more stable.

The reference numbers 822, 823, 824, 825, 826, 827 and 828 are the panels of the column which can be disassembled and connected with the column frame according to the needs.

Figure 19:
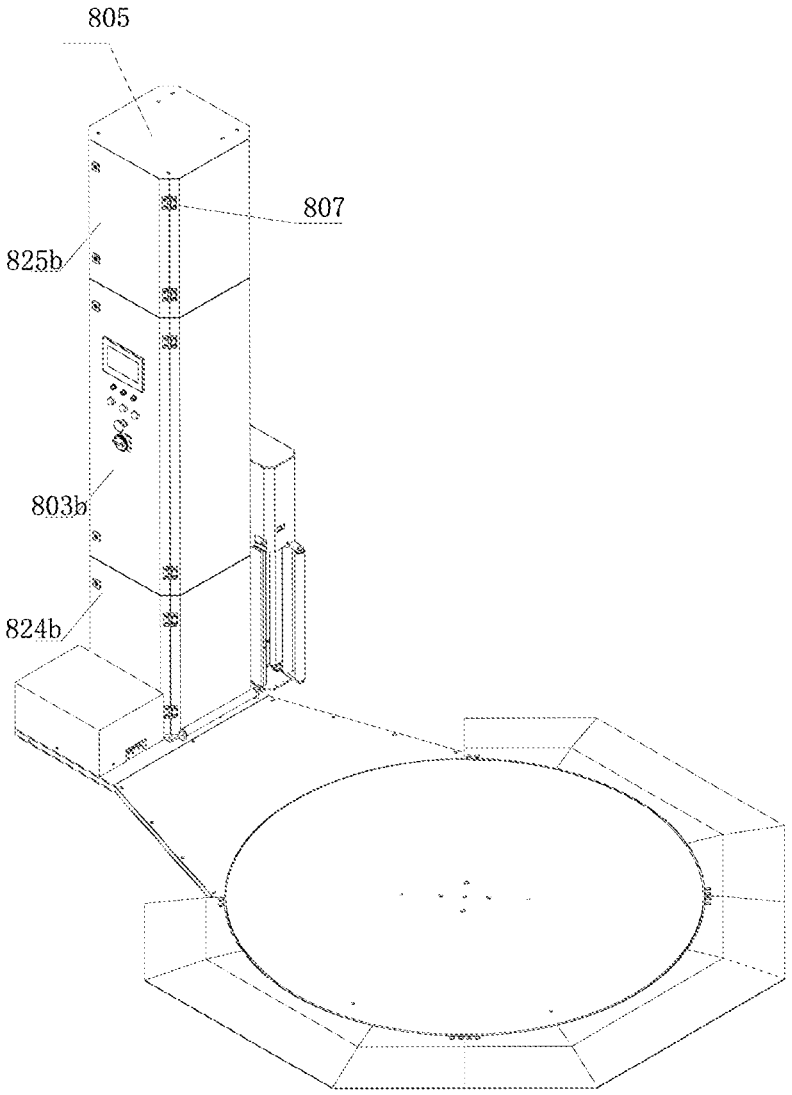
FIG. 19 is a schematic diagram of another embodiment of the embodiment 6 of the present invention.
Figure 20:
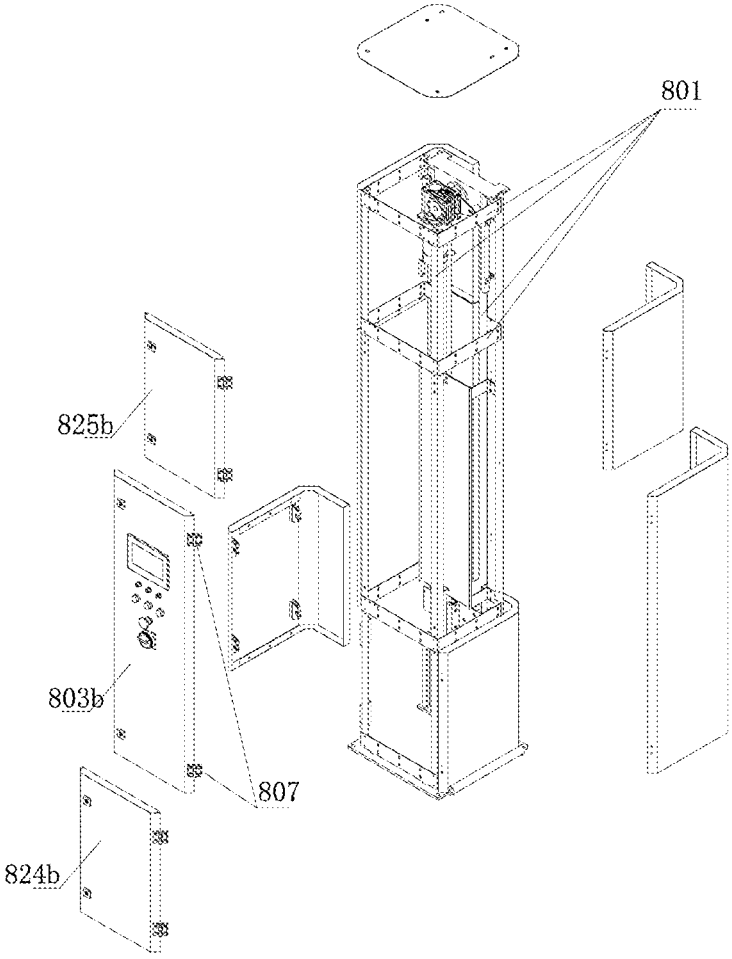
FIG. 20 is an exploded view of another embodiment of the embodiment 6 of the present invention.
Figure 21:
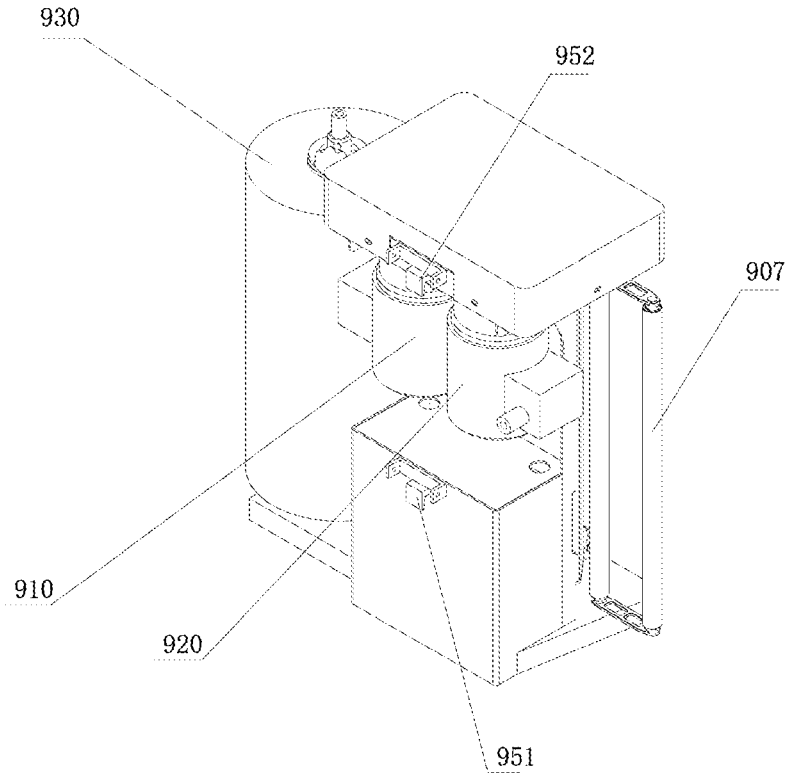
FIG. 21 is a schematic diagram of embodiment 7 of the present invention, mainly showing the back structure of the film feeding frame.
Figure 22:
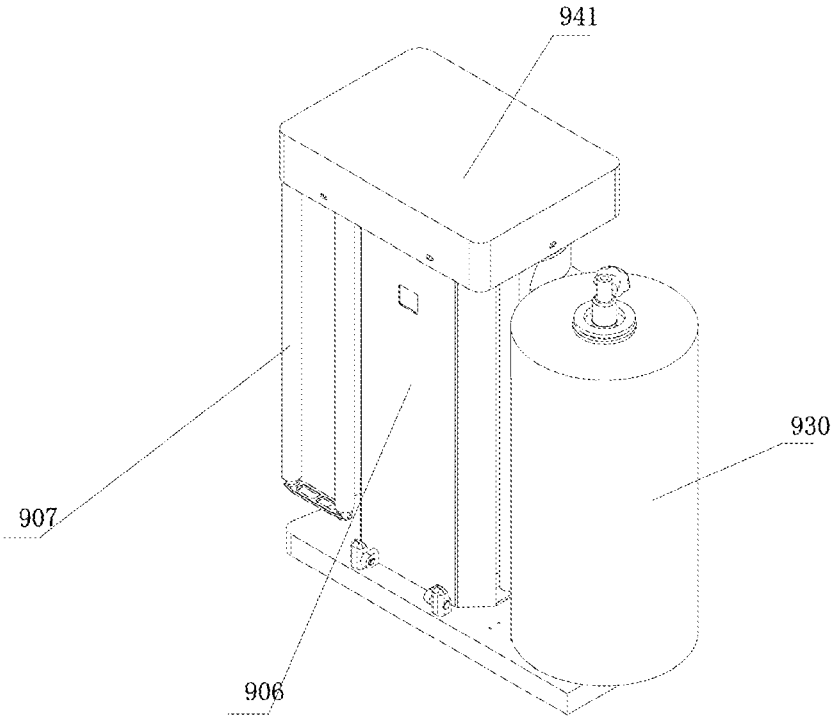
FIG. 22 is the schematic diagram of the embodiment 7 of the present invention, mainly showing the front structure of the film feeding frame.
Figure 23:
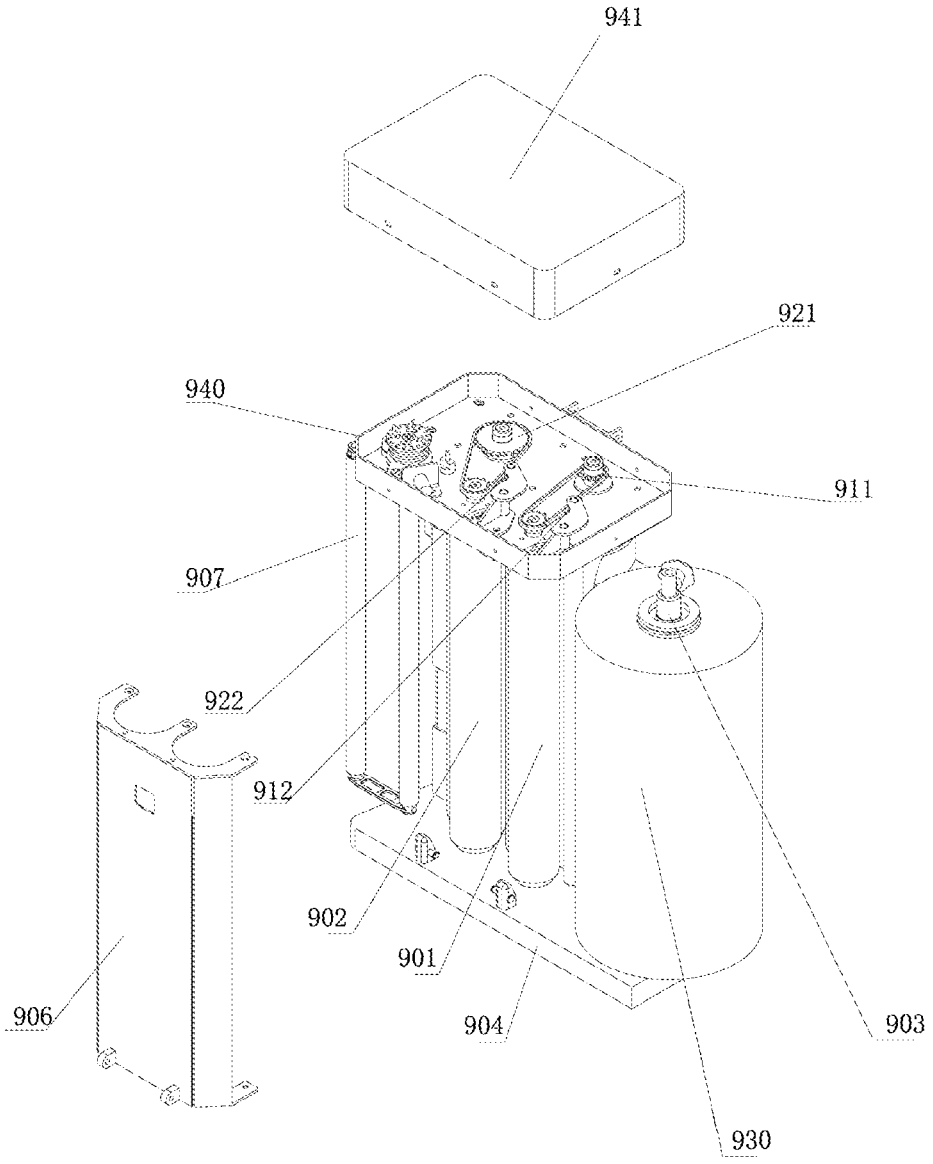
FIG. 23 is an exploded view of the embodiment 7 of the present invention.
Figure 24:
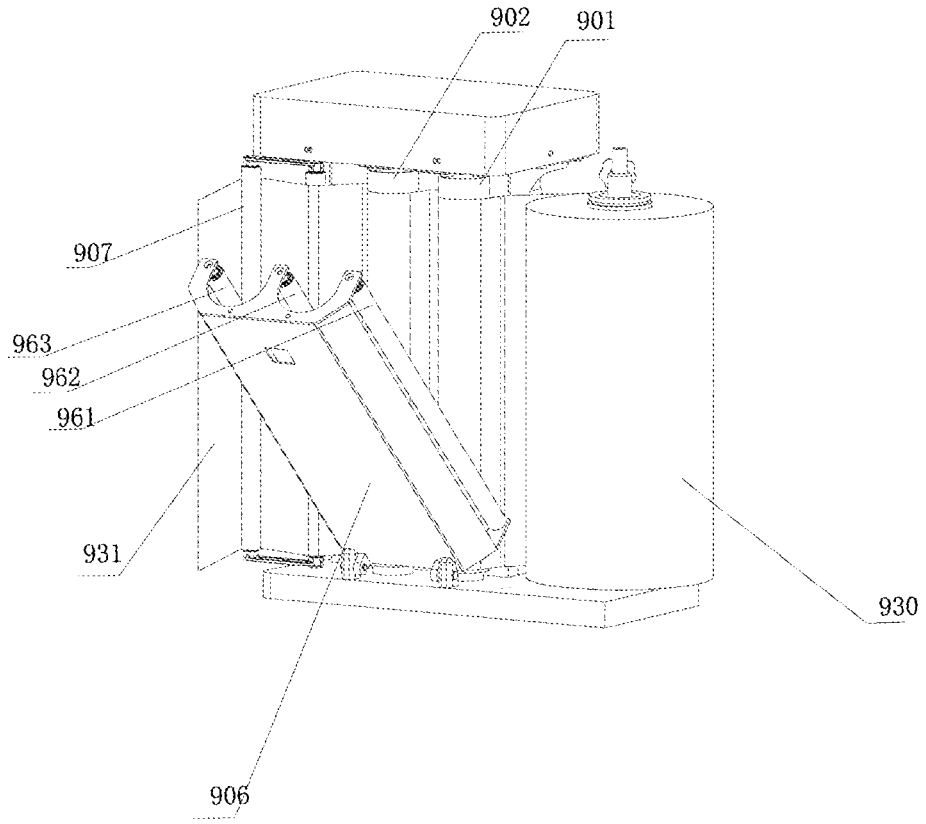
FIG. 24 is the schematic diagram when the door of the film feeding frame is opened in the embodiment 7.

As shown in FIGS. 19-20, for the column shape with four inclined angles, for those column panels that need to be turned and opened, such as electric control door 803*b*, doors 824*b* and 825*b* above and below the electric control door, they can be detachably connected with the adjacent column panels at the inclined angle through hinge 807. In FIGS. 19 and 20, the reference numbers are the same as those in FIGS. 16-18, and represents the same meaning.

For embodiment 7, refer to FIGS. 21-24.

A film feeding device provided by the present invention comprises a film feeding frame 904, a film reel 903, a first roller 901 and a second roller 902, a first driving motor 910 and a second driving motor 920; according to the film feeding direction, the first roller 901 is located at the upstream of the second roller 902, the first roller 901 is used as the main roller, and the second roller 902 is used as the pre-pulling roller.

The first roller 901 and the second roller 902 are respectively connected with the respective driving motors 910 and 920 through respective driving mechanisms 911 and 921. The diameter of the first roller 901 and the diameter of the second roller 902 can be made the same. Alternatively, the diameters of the first roller 901 and the second roller 902 may be different, and the diameter of the first roller 901 is smaller than that of the second roller 902.

The top of the film feeding frame is provided with an upper film frame structure, in which a transmission mechanism is arranged, the first roller and the second roller are connected with respective driving motors through respective transmission mechanisms, and the driving motors are fixed under the upper membrane frame structure.

The positions of the first roller 901 and the second roller 902 are more inclined to the front side of the film feeding frame 904, thus leaving space behind to arrange the first driving motor 910 and the second driving motor 920. The positions of the first driving motor 910 and the second driving motor 920 are behind the first roller and the second roller, and the film reel 903 is arranged on the film feeding frame 904 on the film feeding side of the first roller 901; the reference numeral 930 is the film roll on the film reel 903.

In the space behind the first roller 901 and the second roller 902, the positions and the heights of the first driving motor 910 and the second driving motor 920 correspond to the upper positions of the first roller 901 and the second roller 902, so that the space can be effectively utilized, and a structure 951 connected with the lifting device of the winding machine, such as a hook and its connecting seat, is just set below the structure 951, which is also installed on the film feeding frame.

The top of the film feeding frame 904 is provided with an upper film frame structure 940, the upper film frame structure 940 comprises a cover 941, the upper film frame structure is provided with a transmission mechanism, the first driving motor 910 and the second driving motor 920 are connected with the first roller 901 and the second roller 902 through respective transmission mechanisms, and the first driving motor 910 and the second driving motor 920 are fixed on the upper film frame structure 940. A structure 952 connected with the lifting device of the winding machine is also arranged on the upper film frame structure 940 or the shell 941.

The driving motors 910 and 920 are AC motors, which are better controlled than DC motors, with lower relative cost and convenient control.

As shown in the figure, the transmission mechanisms 911 and 921 adopt the chain transmission mechanism, and can be directly set as the chain transmission mechanism for deceleration. The two transmission mechanisms can be respectively equipped with chain tensioning mechanisms 912 and 922.

The front side of the film feeding frame 904 is provided with a film feeding door 906. The film frame door 906 is connected with a film guide roller 961 before the first roller, a film guide roller 962 between the first roller and the second roller, and a film guide roller 963 after the second roller. The film feeding frame 904 is provided with a film guide roller 907 at the outlet behind the film guide roller 963, and the lower end of the film frame door 906 is hinged with the film feeding frame 904, and the position is locked by a lock structure, which can be a buckle, a bolt, etc. Reference number 931 is the film pulled out.

The first roller 901, the second roller 902 and the film guide rollers 961, 962, 963 and 907 are vertically arranged.

The above description is only the specific embodiments of the present invention, but the structural features of the present invention are not limited to this. The changes or modifications made by any person skilled in the art in the field of the present invention are covered in the protection scope of the present invention.

The invention claimed is:

1. A winding machine comprising a central shaft mechanism, which is arranged on a base of the winding machine, wherein the central shaft mechanism comprises a central shaft component with a base plate, a central shaft projecting from a central part of the base plate, a bearing support structure formed on the base plate and a plurality of first limiting structures radially extending from the base plate, wherein the central shaft component is fixed and limited in the base of the winding machine through the first limiting structures.

2. The winding machine according to claim 1, wherein according to the rotating direction of a turntable of the winding machine when winding a film on the article as the forward direction, a first limiting structure is limited by a limiting structure in front of it.

3. The winding machine according to claim 1, wherein a plurality of first limiting structures are provided on the periphery of the central shaft component; a mounting hole of the central shaft mechanism is arranged on the base of the winding machine, and a connecting groove is arranged along the circumference of the mounting hole of the central shaft mechanism to form a limiting structure with the mounting hole of the central shaft mechanism; a notch of the connecting groove faces the mounting hole of the central shaft mechanism, and the connecting groove has an open part for the first limiting structure to be placed; the mounting hole of the central shaft mechanism and the open part form a central shaft component placing hole; by rotating the central shaft component, the first limiting structure can be clamped between the upper groove wall and the lower groove wall of the connecting groove, and the first limiting structure is connected with the upper groove wall and the lower groove wall of the connecting groove as a whole by bolts.

4. The winding machine according to claim 3, wherein the connecting groove is provided with a second limiting structure as a limiting structure in front of the first limiting structure.

5. The winding machine according to claim 4, wherein when the first limiting structure is blocked by the second limiting structure, the first limiting structure is clamped between the upper groove wall and the lower groove wall of the connecting groove, and bolt holes arranged on the first limiting structure are aligned with bolt holes on the upper groove wall and the lower groove wall.

6. The winding machine according to claim 3, wherein the first limiting structures are keys made of steel plate protruding radially from the central shaft component, and the groove bottom of the connecting groove and the outer side of the keys form a central positioning fit for the central shaft component.

7. The winding machine according to claim 3, wherein the central shaft mechanism is provided with an upper limiting structure, which is a ring-shaped structure, and a plurality of keys protruding to the inner side are arranged on the inner side of the upper limiting structure; the keys form an upper groove wall limiting the first limiting structure, the interval between the keys forms the open part, and the central hole of the ring-shaped structure forms the central insertion hole.

8. The winding machine according to claim 7, wherein the upper limiting structure is made of metal plate.

9. The winding machine according to claim 3, wherein the central shaft mechanism is provided with a middle limit structure, which is a ring-shaped structure that forms the groove bottom of the connecting groove; the inner side has a plurality of keys protruding inward, and the keys serve as the limiting structure in front of the first limiting structure.

10. The winding machine according to claim 3, wherein the connecting groove is a three-layer structure; the central shaft mechanism is provided with an upper limiting structure as an upper structure; the upper limiting structure is a ring structure, and a plurality of keys protruding to the inner side are formed on the inner side, the keys form an upper groove wall limiting the first limiting structure, the interval between the keys forms the open part, the center hole of the ring structure forms the central insertion hole, and the upper limiting structure is made of metal plate;

the central shaft mechanism is provided with a middle limiting structure as a middle structure; the middle limiting structure is a ring structure to form the groove bottom of the connecting groove; the inner side of the middle limit structure is provided with a plurality of keys protruding to the inner side, and the keys are used as a limiting structure in front of the first limiting structure; the middle limit structure is made of metal plate;

the lower groove wall acts as a lower structure.

* * * * *